US007767899B2

(12) United States Patent
Fujita

(10) Patent No.: US 7,767,899 B2
(45) Date of Patent: Aug. 3, 2010

(54) ELECTRONIC MUSICAL INSTRUMENT

(75) Inventor: Akihiro Fujita, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 688 days.

(21) Appl. No.: 11/659,223

(22) PCT Filed: Jun. 24, 2005

(86) PCT No.: PCT/JP2005/011583

§ 371 (c)(1),
(2), (4) Date: Feb. 2, 2007

(87) PCT Pub. No.: WO2006/013683

PCT Pub. Date: Feb. 9, 2006

(65) Prior Publication Data

US 2009/0000462 A1 Jan. 1, 2009

(30) Foreign Application Priority Data

Aug. 2, 2004 (JP) ..... 2004-225260

(51) Int. Cl.
*G10H 1/05* (2006.01)
*G10H 7/00* (2006.01)
*G10H 5/02* (2006.01)

(52) U.S. Cl. ..... 84/622; 84/659; 84/661

(58) Field of Classification Search ..... 84/604, 84/622, 625, 659–661
See application file for complete search history.

(56) References Cited

U.S. PATENT DOCUMENTS 5,252,774 A * 10/1993 Hasebe et al. ..... 84/618
5,468,906 A * 11/1995 Colvin et al. ..... 84/625
5,648,629 A * 7/1997 Kozuki ..... 84/660

FOREIGN PATENT DOCUMENTS

| | | |
|---|---|---|
| JP | 63 267999 | 11/1988 |
| JP | 4 166895 | 6/1992 |
| JP | 7 20859 | 1/1995 |
| JP | 7 219530 | 8/1995 |
| JP | 7 271371 | 10/1995 |
| JP | 07271371 A * | 10/1995 |
| JP | 9 501513 | 2/1997 |
| JP | 9 330079 | 12/1997 |
| JP | 10 293578 | 11/1998 |

* cited by examiner

*Primary Examiner*—Jeffrey Donels
(74) *Attorney, Agent, or Firm*—Oblon, Spivak, McClelland, Maier & Neustadt, L.L.P.

(57) ABSTRACT

An electronic music instrument includes a musical-tone control that generates operation information of keys and a damper pedal to serve as musical-tone control information; a musical-tone generator simultaneously generating a plurality of musical tones according to the musical-tone control information; a resonance-tone generator that includes resonant circuits equal in number to harmonic signals of musical-tone signals that can be generated, for generating a resonance tone with the resonance circuits using a musical tone generated by the musical-tone generator as an input signal to each resonance circuit; and a resonance-tone mixer that multiplies the resonance tone generated by the resonance-tone generator by a predetermined degree according to the musical-tone control information, for adding the product to a musical tone input from the musical-tone generator, and outputting the sum.

29 Claims, 20 Drawing Sheets

ELECTRONIC MUSICAL INSTRUMENT

TECHNICAL FIELD

The present invention relates to electronic musical instruments which can reproduce sound like that during a performance while a piano damper pedal is depressed.

BACKGROUND ART

Vibrations of piano strings are normally suppressed by dampers. Therefore, even if another string is struck, strings that are not struck do not vibrate. In contrast, when the dampers are separated from the strings by stepping on the damper pedal, strings resonate due to vibrations of another struck string. This resonance tone is very important in a piano.

In an electronic musical instrument, as a configuration that can reproduce sound like that during a performance while a damper pedal is depressed, there are a method in which piano tones during operation of the damper pedal are stored and read out (waveform readout), a method in which resonance is caused by delay loops corresponding to the fundamental pitch of input musical tones (delay loop), and other methods.

DISCLOSURE OF THE INVENTION

Problems to be Solved by the Invention

When the waveform readout method of storing and reading out piano tones obtained when operating the damper pedal is employed, it is difficult to obtain a tone with desired characteristics because actual piano tones are collected. There is also a problem in that a large capacity waveform memory is necessary for storing individual tones obtained when the damper pedal is operated.

When using the method of producing resonance using the delay loops, an integer harmonic of the pitch always resonates; however, in an actual piano, in some cases an integer harmonic of a fundamental tone (pitch) does not exist, and in some cases a non-integer harmonic exists. Therefore, there is a problem in that it is not possible to realize such phenomena with this method.

Naturally, these problems are not limited only to pianos. The same thing also applies to musical instruments in which a resonance tone is reflected. (In the description below, basically resonance by a piano damper is taken as an example, but the present invention is not limited thereto.)

The present invention has been conceived in light of the problems described above. An object of the present invention is to provide an electronic musical instrument capable of generating a resonance tone in which harmonic levels are finely adjusted easily and which is close to actual resonance, using a simple configuration.

Means for Solving the Problems

In order to solve the problems described above, as a result of extensive investigation, the present inventors have devised the following three basic configurations of the present invention. In two of those basic configurations, a generated musical tone is input to resonance circuits to generate a resonance tone, which is then mixed with the original musical tone. In the remaining basic configuration, a resonance tone is generated simultaneously with the musical tone using operating information of an operator as a trigger, and both tones are mixed.

For musical tone generation in any of these configurations, there are a case in which a musical-tone waveform is stored in musical-tone-waveform storing means and read out to generate the musical tone (in this case, in all the three configurations, the musical-tone-waveform storing means is included in musical-tone generating means), and a case in which a musical tone is synthesized using predetermined musical-tone control information to generate the musical tone; neither case is eliminated. Outlines of the three configurations will be described below.

In a first configuration, a musical tone signal is input to resonance circuits corresponding to harmonics of the musical tone in resonance-tone generating means to generate a resonance tone.

Here, each resonance circuit corresponding to a harmonic of a musical tone is designed by determining the harmonic frequency and damping factor by analyzing the original waveform (the original collected waveform if using the method of reading out a musical tone waveform from waveform storing means) and using them as design parameters.

Such a resonance circuit is formed of a circuit that includes a filter (and in some cases, also a multiplier), and the filter coefficients thereof are determined by bilinear transformation of the transfer function of a single-degree-of-freedom viscous damping model in which the harmonic frequency of the harmonic is defined as an undamped natural angular frequency and the damping factor is defined as an exponent obtained when damping of the harmonic is approximated using an exponential function. If the multiplier described above is used, the multiplication factor thereof is set to a value obtained by multiplying the amplitude ratio with a reference harmonic of a musical tone that includes the harmonic corresponding to the multiplier, by a predetermined degree.

Because it is easy to understand by taking as an example the musical-tone waveform readout method for reading out a musical-tone waveform from the musical-tone waveform storing means in which musical-tone waveforms are stored, the description below will be given based on the waveform readout method. As described above, however, there are a method in which the musical-tone waveform is stored in the musical-tone-waveform storing means and read out, and a method in which a musical tone is synthesized using predetermined musical-tone control information to generate the musical tone. In the present invention, it is possible to use either method.

The original waveform of the read-out waveform data is analyzed for each harmonic to design a resonance circuit for the harmonic. Therefore, there are no resonance circuits corresponding to harmonics that are not included in the original waveform data, and resonance tones of the harmonic frequencies of the harmonics are thus never generated (but it is possible to add a resonance circuit for a desired harmonic). In addition, because it is possible to have a resonance circuit for a harmonic with a non-integer multiple of a pitch, it is possible to generate a resonance tone with the harmonic frequency of the harmonic.

Therefore, it is possible to generate a resonance tone closer to that of the original musical instrument. Also, because it is possible to adjust the level of each harmonic of the resonance tone, it is easy to obtain a desired tonal quality.

In a second configuration, a musical tone is generated by musical-tone generating means, and in addition, a resonance tone is obtained by inputting a musical-tone signal to resonance-tone generating means formed of a plurality of series (twelve in a general musical instrument such as a piano) of resonance circuit groups corresponding to the note names of musical tones [in a general musical instrument such as a piano, C (Do), C♯ (Do♯), D (Re), D♯ (Re♯), E (Mi), F (Fa), F♯ (Fa♯), G (So), G♯ (So♯), A (La), A♯ (La♯), and B (Si)]. By inputting the musical-tone signal with a small amplitude to a resonance circuit group of the same note name and with a large amplitude to resonance circuits of different note names, the output of the resonance circuit group with the same note name is prevented from significantly increasing compared with the outputs of the other resonance circuit groups. Thus, a resonance tone with good balance is obtained. Details of the principle of such a configuration will be described below.

Each resonance circuit described above corresponds to a harmonic of a musical tone. The resonance circuit corresponding to the harmonic of the musical tone is designed by determining the harmonic frequency and damping factor, by analyzing the original waveform (the original collected waveform if using the method of reading out musical-tone waveforms from waveform storing means), and using them as design parameters.

Similarly to the first configuration described above, the resonance circuit is formed of a circuit that includes a filter (and also a multiplier in some cases), and the filter coefficient thereof is determined by a bilinear transformation of the transfer function of a single-degree-of-freedom viscous damping model in which the harmonic frequency of the harmonic is defined as an undamped natural angular frequency and the damping factor is defined as an exponent obtained when damping of the harmonic is approximated by an exponential function. When the multiplier described above is used, the multiplication factor thereof is set to a value obtained by multiplying the amplitude ratio with a reference harmonic of a musical tone that includes the harmonic corresponding to the multiplier, by a predetermined degree.

Because it is easy to understand by taking as an example the musical-tone readout method of reading out a musical-tone waveform from the musical-tone-waveform storing means which stores musical-tone waveforms, the description below will be given based on the waveform-readout method. However, as described above, there are a method in which the musical-tone waveform is stored in the musical-tone-waveform storing means and read out, and a method in which a musical tone is synthesized using predetermined musical-tone control information to generate the musical tone. In the present invention, it is possible to use either method.

The original waveform of the read out waveform data is analyzed for each harmonic to design a resonance circuit for the harmonic. Therefore, there are no resonance circuits for harmonics that are not included in the original waveform data, and resonance tones of the harmonic frequencies of the harmonics are never generated (but it is possible to add a resonance circuit for a desired harmonic). In addition, because it is possible to have a resonance circuit for a harmonic with a non-integer multiple of a pitch, it is possible to generate a resonance tone with the harmonic frequency of the harmonic.

Therefore, it is possible to generate a resonance tone that is closer to the original musical instrument. Also, because it is possible to adjust the level of each harmonic of the resonance tone, it is easy to obtain a desired tonal quality.

In a third configuration, by storing in advance, in resonance-tone-waveform storing means, resonance tones obtained by inputting musical tone signals that can be generated, to a plurality of resonance circuits corresponding to harmonics of the musical tones and reading out the waveforms thereof in response to a performance (operating information about operators), for, e.g., a piano, sound like that during a performance while pressing a damper pedal is reproduced.

The resonance circuits corresponding to the harmonics of a musical tone are designed by determining the harmonic frequencies and damping factors by analyzing the original waveform (the original collected waveform if using the method of reading out musical-tone waveforms from waveform storing means), and using them as design parameters. The resonance circuits in this third configuration are necessary because the resonance-tone waveforms are stored in the resonance-tone-waveform storing means. Unlike the other two basic configurations, once the resonance-tone waveforms have been stored, the resonance circuits are not necessary in the electronic musical instrument unless a new resonance-tone is stored.

Similarly to the first and second configurations described above, each resonance circuit is formed of a circuit that includes a filter (and also a multiplier in some cases), and the filter coefficient thereof is determined by bilinear transformation of the transfer function of a single-degree-of-freedom viscous damping model in which the harmonic frequency of the harmonic is defined as an undamped natural angular frequency and the damping factor is defined as an exponent obtained when the damping of the harmonic is approximated by an exponential function. When the above-mentioned multiplier is used, the multiplication factor thereof is set to a value obtained by multiplying the amplitude ratio with a reference harmonic of a musical tone that includes the harmonic corresponding to the multiplier, by a predetermined degree.

In this configuration, similarly to the two configurations described above, when the musical-tone-waveform readout method of reading out musical-tone waveforms from musical-tone-waveform storing means which stores the musical-tone waveforms is taken as an example, the original waveform of read-out waveform data is analyzed for each harmonic to design the resonance circuit for the harmonic. Therefore, of the separately provided resonance circuits for creating resonance-tone waveforms finally stored in the resonance-tone-waveform storing means, there are no resonance circuits corresponding to harmonics that are not included in the original waveform data, and resonance tones of the harmonic frequencies of the harmonics are never generated. (While the resonance-tone waveforms are stored in the resonance-tone waveform storing means, there are a case in which musical-tone waveforms are similarly stored in musical-tone waveform storing means and read out, and a case in which a musical tone is synthesized using predetermined musical-tone control information to generate the musical tone. Also, it is possible to add a resonance circuit for a desired harmonic.) In addition, because it is possible to have a resonance circuit corresponding to a harmonic with a non-integer multiple of a pitch, it is possible to generate a resonance tone with the harmonic frequency of the harmonic.

Therefore, it is possible to generate a resonance tone closer to the original musical instrument. Also, because it is possible to adjust the level of each harmonic in the resonance tone, it is easy to obtain a desired tonal quality.

In the present application, the first configuration described above is defined by claims 1 to 10, as follows. The second configuration is defined by Claims 11 to 21, as follows. The third configuration is defined by Claims 22 to 29, as in the description given below.

An electronic musical instrument according to Claim 1 has a basic feature in that it includes, at least for outputting a musical tone: musical-tone control means including a plurality of operators, for generating operating information of the plurality of operators as musical-tone control information for specifying at least a sound-generation start, a sound-generation stop, a pitch, an operating intensity, and an operating amount; musical-tone generating means capable of simultaneously generating a plurality of musical tones according to the musical-tone control information; resonance-tone generating means including resonance circuits equal in number to harmonic signals of musical-tone signals that can be generated, for generating a resonance tone with the resonance circuits using a musical tone generated by the musical-tone generating means as an input signal to each resonance circuit; and resonance-tone mixing means for multiplying the resonance tone generated by the resonance-tone generating means, by a predetermined degree according to the musical-tone control information, for adding the product to the input musical tone from the musical-tone generating means, and for outputting the sum.

As described above, the configuration generates a resonance tone by inputting a musical tone signal generated by the musical-tone generating means to the resonance circuits corresponding to the harmonics of the musical tone in the resonance-tone generating means. The resonance tone thus generated is mixed with the original musical tone by the resonance-tone mixing means.

Such a resonance circuit is designed by determining the harmonic frequency and damping factor by analyzing the original waveform and using them as design parameters. When the musical-tone waveform readout method of reading out musical-tone waveforms from musical-tone-waveform storing means which stores the musical-tone waveforms is taken as an example, the original waveform of read-out waveform data is analyzed for each harmonic to design a resonance circuit for the harmonic. Therefore, there are no resonance circuits corresponding to harmonics that are not included in the original waveform data, and resonance tones of the harmonic frequencies of the harmonics are thus never generated (but it is possible to add a resonance circuit for a desired harmonic). Also, because it is possible to have a resonance circuit corresponding to a harmonic with a non-integer multiple of a pitch, it is possible to generate a resonance tone of the harmonic frequency of the harmonic.

Therefore, it is possible to generate a resonance tone that is closer to that of the original musical instrument. In addition, because it is possible to adjust the level of each harmonic of the resonance tone, it is easy to obtain a desired tonal quality.

There are the method in which musical-tone waveforms are stored in musical-tone-waveform storing means and read out, and the method in which a musical tone is synthesized using predetermined musical-tone control information to generate the musical tone; it is possible to use either method in the configuration of the present invention.

In the configuration of Claim 2, which specifies the configuration of the resonance-tone generating means described above, as shown in a first embodiment described later, a plurality of resonance circuits which correspond to harmonics of a musical tone and whose resonance frequencies are defined by the harmonic frequencies of the harmonics are connected in parallel to constitute the resonance-tone generating means.

The configuration of Claim 3 specifies the configuration of the resonance circuits according to an embodiment described later; more specifically, the resonance circuits comprise digital filters, and regarding filter coefficients used in each of these filters, an impulse response of the resonance circuit is defined to approximately simulate a vibration waveform of a harmonic, and the vibration waveform can be reproduced by a single-degree-of-freedom viscous damping model; model parameters for determining the behavior of the single-degree-of-freedom viscous damping model are defined as a mass, damped natural frequency, and damping factor, and given these, a viscosity coefficient and stiffness coefficient, serving as coefficients of an equation of motion of the model, are determined; the equation of motion of the model is subjected to a Laplace transform to obtain a transfer function formula in terms of "s", and the filter coefficients in terms of "z" are determined by substituting the determined viscosity coefficient, stiffness coefficient, and mass in the transfer function formula and performing a bilinear transformation; and the mass is defined as a desired value, the damped natural frequency is the frequency of the harmonic to be simulated, and the damping factor is defined as an exponent obtained when damping of the harmonic is approximated by an exponential function to determine the values thereof, and the values serve as the filter coefficients.

Here, the design of the resonance circuits used in common in the three basic configurations described above in the present application will be described (in the third basic configuration, the resonance circuits separately provided and used when the resonance-tone waveforms are created).

One resonance circuit is designed to simulate the behavior of one harmonic of a pitch. However, to sufficiently simulate temporal changes in the resonance frequency or amplitude, the circuit scale becomes too large; therefore, it is acceptable to simulate them approximately.

For the filter portion of a resonance circuit, the transfer function is obtained from the equation of motion of a single-degree-of-freedom viscous damping model. The single-degree-of-freedom viscous damping model is shown in FIG. 1.

This figure shows a single-degree-of-freedom viscous damping model represented by a spring (stiffness), a mass, and a dashpot (viscosity). (Usually, viscosity is represented by a damper, but because a piano damper pedal appears in the present application, it is represented by a dashpot to avoid confusion.) Here, K is the stiffness coefficient, C is the viscosity coefficient, M is the mass, x is the displacement of the mass, and f(t) represents force exerted on the mass. The equation of motion of the model at this time is as shown in Equation 1 below.

$$M\frac{d^2x(t)}{dt^2} + C\frac{dx(t)}{dt} + Kx(t) = f(t) \qquad \text{[Equation 1]}$$

Equation 1 is subjected to a Laplace transform to obtain the transfer function thereof, as shown in Equation 2 below. Regarding the form of this transfer function in Equation 2, the numerator includes only a constant term, and the denominator is a second-order polynomial of "s". Therefore, it is possible to represent it as a second-order low-pass filter (LPF).

$$Ms^2X(s) + CsX(s) + KX(s) = F(s) \qquad \text{[Equation 2]}$$

$$G(s) = \frac{X(s)}{F(s)} = \frac{1}{Ms^2 + Cs + K}$$

The coefficients for representing the behavior of the single-degree-of-freedom viscous damping model and relational expressions thereof are generally known and are shown in Equations 3 to 7 below.

The undamped natural angular frequency is ω, the critical damping factor is cc, the damping ratio is ζ, the damping factor is σ, and the damped angular frequency is ωd. Also, as described earlier, K represents the stiffness coefficient, C represents the viscosity coefficient, and M represents the mass.

$$\Omega=\sqrt{K/M} \quad \text{[Equation 3]}$$

$$c_c=2M\Omega \quad \text{[Equation 4]}$$

$$\zeta=C/c_c \quad \text{[Equation 5]}$$

$$\sigma=\Omega\cdot\zeta \quad \text{[Equation 6]}$$

$$\omega_d=\Omega\sqrt{1-\zeta^2} \quad \text{[Equation 7]}$$

Here, the damped angular frequency ωd is defined by multiplying the frequency of the harmonic to be simulated by 2π, and the damping factor σ is defined as an exponent obtained when the damping of the harmonic to be simulated is approximated by an exponential function. The mass can be set to any value, but here, is set to 1. Thus, if the damped natural angular frequency ωd, the damping factor σ, and the mass M are already known, the viscosity coefficient C and the stiffness coefficient K, which are coefficients of the denominator polynomial of the transfer function G(s), can be obtained as follows.

That is, substituting Equation 4 and an equation obtained by transforming Equation 6, into Equation 5 yields Equation 8 below.

$$\frac{\sigma}{\Omega}=\frac{C}{2M\Omega} \quad \text{[Equation 8]}$$

Therefore, the viscosity coefficient C is as shown in Equation 9 below.

$$C=2M\sigma \quad \text{[Equation 9]}$$

The damped natural angular frequency ωd is a value obtained by multiplying the resonance frequency of the resonance circuit by 2π (in other words, the damped natural angular frequency=the resonance frequency, with the only difference being their units, rad and Hz). Substituting Equation 4 into Equation 7 yields Equation 10 shown below.

$$\omega_d=\Omega\sqrt{1-\frac{C^2}{4M^2\Omega^2}} \quad \text{[Equation 10]}$$

Solving Equation 10 for Ω yields Equation 11 below.

$$\Omega=\sqrt{\omega_d^2+\frac{C^2}{4M^2}} \quad \text{[Equation 11]}$$

Substituting the result of Equation 11 into Equation 3 gives the stiffness coefficient K, as shown in Equation 12 below.

$$K=\Omega^2\cdot M \quad \text{[Equation 12]}$$

From the above, all coefficients in the transfer function in terms of "s" are determined.

To implement this with a digital filter, it is necessary to obtain a transfer function in terms of "z" by bilinear transformation. Bilinear transformation means replacing "s" as shown in Equation 13 below and is generally known. T represents a sampling time and "z" represents a unit delay.

$$s=2/T\{(1-z^{-1})/(1+z^{-1})\} \quad \text{[Equation 13]}$$

Substituting Equation 13 into Equation 2 yields Equation 14 below.

$$\begin{aligned}\frac{1}{Ms^2+Cs+K}&=\frac{1}{M[2/T\cdot\{(1-z^{-1})/(1+z^{-1})\}]^2+C\cdot 2/T\cdot\{(1-z^{-1})/(1+z^{-1})\}+K}\\&=\frac{(1+z^{-1})^2}{M\{2/T\cdot(1-z^{-1})\}^2+C\cdot 2/T\cdot\{(1-z^{-1})(1+z^{-1})\}+K(1+z^{-1})^2}\end{aligned} \quad \text{[Equation 14]}$$

Here, when this equation is arranged in terms of the mass M, the viscosity coefficient C, and the stiffness coefficient K, the following Equations 15 to 17 are obtained.

$$M\{2/T\cdot(1-z^{-1})\}^2=4M/T^2(1-2z^{-1}+z^{-2}) \quad \text{[Equation 15]}$$

$$C\cdot 2/T\cdot\{(1-z^{-1})(1+z^{-1})\}=2C/T(1-z^{-2}) \quad \text{[Equation 16]}$$

$$K(1+z^{-1})^2=K(1+2z^{-1}+z^{-2}) \quad \text{[Equation 17]}$$

Here, Equation 2, which is the transfer function, is expressed by Equation 18 below.

$$\frac{1}{Ms^2+Cs+K}=\frac{1+2z^{-1}+z^{-2}}{b0+b1\cdot z^{-1}+b2z^{-2}} \quad \text{[Equation 18]}$$

The coefficients of the denominator polynomial are determined from Equations 15 to 17 above, as in Equation 19 below.

$$\left.\begin{aligned}b0&=4M/T^2+2C/T+K\\b1&=-\frac{8M}{T^2}+2K\\b2&=\frac{4M}{T^2}-\frac{2C}{T}+K\end{aligned}\right\} \quad \text{[Equation 19]}$$

As described above, if the damped natural angular frequency ωd, the damping factor σ, and the mass M are already known, the resonance circuit can be realized.

A method of determining the damped natural angular frequency ωd and the damping factor σ will be described below.

The damped angular frequency ωd is defined as the frequency of the harmonic to be simulated, multiplied by 2π. The frequency of the harmonic can be determined by FFT analysis, by carrying out the zero-crossing method for a harmonic extracted from the musical note by a bandpass filter (BPF), or by other methods. This is a generally known method, and a detailed description thereof is omitted here.

FIG. 2 shows, in a simple manner, the amplitude-frequency characteristic obtained by FFT analysis of the musical tone A_0. In the figure, f1 is the frequency of the first harmonic of A_0, f2 is the frequency of the second harmonic, and fN1 is the frequency of the highest-order harmonic. Therefore, in resonance-tone generating means in FIG. 20 stated in an embodiment described later, the damped natural angular frequency of a filter filterA0-1 is f1×2π; similarly, the damped natural angular frequencies of a filter filterA0-2 and a filter filterA0-N1 are f2×2π and fN1×2π, respectively.

The damping factor σ is defined as an exponent obtained when the damping of the harmonic to be simulated is approximated by an exponential function. In this example, a damping factor σ at which the least square error of the waveform of the harmonic and the sinusoidal wave according to Equation 20 below is minimized is used. (σ is set so as to minimize the difference in waveforms of FIG. 3 (showing the state of the waveform of the actual first harmonic of A_0) and FIG. 4 (showing the state of the waveform approximating the waveform of FIG. 3 by Equation 20), which are described later.)

$$x(t)=A\cdot e^{-\sigma\cdot t}\cos\omega_d\cdot t \quad \text{[Equation 20]}$$

x(t) indicates an instantaneous value of a sinusoidal wave, and A is the amplitude, which is desirably determined. ωd is a value defined as the above-described specified harmonic frequency multiplied by 2π, t is time, and σ is the damping factor. A is the maximum amplitude of the harmonic to be approximated.

Apart from the method described above, it is also possible to use a method in which the envelope of the harmonic is extracted and approximated by a logarithmic function, or the like. FIGS. 3 and 4 show the actual waveform of the first harmonic of A_0 and the waveform approximating it by using Equation 20.

The method of determining the least square error, the FFT-analysis method, the method of measuring the zero-crossing time, and so on are generally known, and detailed descriptions thereof are omitted here.

The configuration of Claim 4 specifies a configuration in a case where multipliers are provided so as to be respectively connected in series to the digital filters of the resonance circuits, as described above; more concretely, the multiplication factor of each of the multipliers is set to a value obtained by multiplying the amplitude ratio with a reference harmonic of a musical tone that includes the harmonic corresponding to the multiplier, by a predetermined degree.

Thus, when the resonance circuits are provided with multipliers, the multiplication factors of the multipliers can be determined by FFT analysis or the like. Multipliers M3-A0-1, M3-A0-2, and M3-A0-N1 in FIG. 20, described later, can be determined as follows.

FIG. 2 shows the amplitude-frequency characteristic obtained by FFT analysis, for the musical-tone waveform of A_0 n a simple manner.

For the first harmonic, the frequency is f1 Hz and the amplitude level is 0 dB, and for the second harmonic, the frequency is f2 Hz and the amplitude level is −20 dB. For the N1-th harmonic (the highest-order harmonic), the frequency is fN1 Hz and the amplitude level is −40.

Therefore, regarding the amplitude ratio, when the first harmonic is defined as 1 (reference), the second harmonic is $10^{(-20/20)}=0.1$, and the N1-th harmonic is $10^{(-40/20)}=0.01$. Therefore, the multiplication factor of the multiplier M3-A0-1 in FIG. 20 is 1; similarly, the multiplication factor of the multiplier M3-A0-2 is 0.1, and the multiplication factor of the multiplier M3-A0-N1 is 0.01. The multiplication factors of multipliers used in resonance circuits for the other pitches are determined in the same way using musical tones of those pitches.

In this example, the first harmonic of A_0 is defined as 1, but a desired harmonic of another pitch may be defined as 1, and the values of the multiplication factors for A_0 may be changed while the amplitude ratios between harmonics of the pitch are maintained, such as 0.5 for the first harmonic, 0.05 for the second harmonic, . . . , and 0.005 for the N1-th harmonic. In addition, to obtain a more preferable tonal quality, desired values may be set without using analysis.

The harmonic to be simulated will be discussed next.

For an electronic piano using the so-called readout method in which a musical tone is generated when musical-tone generating means reads out a corresponding stored musical-tone waveform, it is known that musical-tone waveforms of an acoustic piano are collected and stored. Therefore, to determine the resonance frequency and damping factor of a resonance circuit, it is possible to extract and use the harmonic to be simulated from the original collected waveforms (Claim 5).

Thus, when the first harmonic of A_0 is to be simulated, the resonance frequency is specified and the damping is approximated by zero-crossing analysis by extracting the first harmonic from a musical-tone waveform of A_0 with a bandpass filter (BPF) centered on the f1 harmonic and having a bandwidth less than f1.

FIG. 5 shows the bandwidths of bandpass filters (BPFs). In this figure, regions indicated by arrows are the pass bands of the bandpass filters (BPFs).

In a case where the musical-tone generating means synthesizes a musical tone using predetermined musical-tone control information to generate the musical tone (the so-called readout method is not used), the resonance frequencies are specified and the damping is approximated by applying FFT analysis or zero-crossing analysis to collected musical tones generated from the musical-tone generating means using the predetermined musical-tone control information. In other words, the harmonic to be simulated is extracted from the output musical-tone waveforms synthesized using predetermined musical-tone control information (Claim 6).

The above-described configuration of the present invention, in which the resonance frequencies and damping factors are determined by extracting each harmonic from actual piano sound, has the following advantages compared with a conventional case in which a resonance tone is generated using delay loops.

The harmonics of an actual piano are not strictly integer multiples of fundamental tones, but are shifted slightly. If the order of the harmonic is high (if the frequency of the harmonic is high), it is known that the frequency shifts to a higher frequency from the integer multiple of the fundamental tone. There are some cases where harmonics do not exist where they are supposed to. In contrast, there are also some cases where harmonics exist where they are supposed not to (in this case, they should probably not be called harmonics). This behavior differs from one piano to another and is characteristic of that musical instrument.

Because a conventional delay-loop type resonance circuit accurately resonates at a frequency which is an integral multiple of the reciprocal of the delay time, it cannot handle the phenomenon described above. However, the configuration of the present invention, in which the resonance circuits are designed by extracting actual piano harmonics one by one, can correctly reproduce this phenomenon.

In the first basic configuration, an input musical tone is used as a fundamental tone, and resonance circuits equal in number to and corresponding to harmonics of the fundamental tone are prepared. Claim 7 specifies a configuration which can reduce the number of such resonance circuits. More concretely, the resonance frequency of one resonance circuit corresponds to one harmonic frequency, but when there are a plurality of harmonics of the same harmonic frequency or harmonic frequencies that are extremely close, one harmonic frequency is set as a representative frequency, and only one resonance circuit whose resonance frequency is defined by that harmonic frequency is used for the plurality of harmonics.

For example, if the fundamental (first harmonic) frequency of a musical tone of a certain pitch is f1, the frequency of the second harmonic is about (f1×2) Hz, the frequency of the third harmonic is about (f1×3) Hz, and the frequency of the fourth harmonic is about (f1×4 Hz). The fundamental frequency of a musical tone one octave above is about (f1×2) Hz, and the frequency of the second harmonic is about (f1×4) Hz. The fundamental frequency of a musical tone two octaves above is (f1×4) Hz. Therefore, the frequency of the second harmonic of a certain pitch and the fundamental frequency one octave above are substantially equal. Similarly, the frequency of the fourth harmonic of a certain pitch, the frequency of the second harmonic one octave above, and the fundamental frequency two octaves above are substantially equal.

Even when there is no octave relationship, there are instances where the frequencies of harmonics of different orders of different pitches are extremely close.

Separate resonance circuits do not need to be provided for such harmonics whose frequencies are substantially equal; it is acceptable to provide one resonance circuit whose resonance frequency is defined as the frequency of one harmonic or the average frequency of the harmonics. This enables the circuit scale of the resonance-tone generating means of the first basic configuration described above to be reduced.

FIG. 6 shows, in order from the top, harmonics of C_2, C_3, and C_4 by FFT analysis. In this figure, the portions of the harmonics surrounded by rectangles can be produced with one resonance circuit. It is thus possible to omit the parts of the circuits corresponding to those portions.

FIG. 7 shows, in order from the top, harmonics of C_4, E_4, and A_4 by FFT analysis. In this figure, the portions of the harmonics surrounded by a rectangle can be produced with one resonance circuit. It is thus possible to omit the parts of the circuits corresponding to those portions.

On the other hand, when the frequency of a harmonic included in the musical tone input to a resonance circuit and the resonance frequency of the resonance circuit to which it is input are extremely close, the resonance tone output from the resonance circuit is extremely large compared with a case in which the frequency of a harmonic included in the musical tone input to a resonance circuit and the resonance frequency of the resonance circuit to which it is input are far from each other (when a harmonic frequency of the musical tone and the resonance frequency of the resonance circuit are close, the amplitude of the resonance circuit output becomes excessively large). In this case, rather than sound like the actual resonance tone to be obtained, it sounds like a steady musical tone having that resonance frequency. FIGS. 8 and 9 show examples thereof.

FIG. 8 shows, in order from the top, resonance tones obtained when a musical tone C_2 is input to a resonance circuit for the first harmonic of C_2, a resonance circuit for the first harmonic of C_3, and a resonance circuit for the first harmonic of G♯_2, respectively. FIG. 9 shows, in order from the top, resonance tones obtained when a musical tone G♯_2 is input to the resonance circuit for the first harmonic of C_2, the resonance circuit for the first harmonic of C_3, and the resonance circuit for the first harmonic of G♯_2.

In FIG. 8, the resonance tones of the resonance circuit for the first harmonic of C_2 and the resonance circuit for the first harmonic of C_3 are large. This is because the musical tone C_2 has harmonics of frequencies extremely close to the frequencies of the first harmonic of C_2 and the first harmonic of C_3. Similarly, in FIG. 9, the amplitude of the resonance tone of the resonance circuit for the first harmonic of G♯_2 is large. Thus, in the case shown in FIG. 8, the resonance tone sounds like the musical tone C_2. Similarly, in the case shown in FIG. 9, it sounds like the musical tone G♯_2. Thus, it does not sound as if the damper pedal is operated in the case of a piano.

In the configuration of Claim 8, the resonance frequency of one resonance circuit corresponds to one harmonic frequency, but the resonance-tone generating means is configured to include a resonance circuit whose resonance frequency corresponding to a specific harmonic frequency is shifted by a predetermined amount.

In other words, to make the amplitudes of the resonance tones shown in FIGS. 8 and 9 substantially the same, the resonance frequencies of the resonance circuits should be slightly shifted.

The results obtained by the configuration in Claim 8 are shown in FIGS. 10 and 11.

FIG. 10 shows, in order from the top, resonance tones obtained when the musical tone C_2 is input to a resonance circuit whose resonance frequency is shifted by several hertz from the first harmonic of C_2, a resonance circuit whose resonance frequency is shifted by several hertz from the first harmonic of C_3, and a resonance circuit whose resonance frequency is shifted by several hertz from the first harmonic of G♯_2, respectively.

FIG. 11 shows, in order from the top, resonance tones obtained when the musical tone G♯_2 is input to the resonance circuit whose resonance frequency is shifted by several hertz from the first harmonic of C_2, the resonance circuit whose resonance frequency is shifted by several hertz from the first harmonic of C_3, and the resonance circuit whose resonance frequency is shifted by several hertz from the first harmonic of G♯_2, respectively.

As is clear from these figures, by slightly shifting the resonance frequencies of the resonance circuits, it is possible to make the amplitudes of the resonance tones substantially the same.

In a piano, string vibrations are transmitted to a sounding board, which produces sound. At the same time, those vibrations are also transmitted to other strings via bridges. The vibrations transmitted to the other strings are then transmitted back to the original string via the bridges. Therefore, a piano has such a feedback circuit. In order to achieve this in a simple manner, the resonance-tone generating means is provided with a feedback path. In other words, the resonance-tone generating means has a configuration in which the output thereof is multiplied by a predetermined degree, is added to the input musical tone, and is input again to the resonance-tone generating means as feedback (Claim 9).

As in the configuration of Claim 10, the resonance-tone generating means may have a configuration in which the output of the resonance-tone generating means is multiplied by a predetermined degree, is added to the input musical tone, and is input again to this resonance-tone generating means as feedback, and, in addition, in the feedback path, a delay circuit for delaying the output of the resonance-tone generating means by a predetermined time and/or a filter for changing the amplitude-frequency characteristic of the output of the resonance-tone generating means. In that case, the delay circuit simulates the propagation delay of the vibrations, and the filter simulates the transfer characteristic of the bridges.

Next, the configuration of an electronic musical instrument according to Claim 11, which forms the core of the second basic configuration of the present application, will be described. With this configuration, a musical tone is generated with musical-tone generating means, and a resonance tone is obtained by inputting a musical-tone signal to resonance-tone generating means formed of a plurality of series (12 series) of resonance circuit groups corresponding to note names (C, C♯, D, . . . , B in a general musical instrument such as a piano) of musical tones, as described above.

At this time, by inputting a musical-note signal to the resonance circuit group of the same note name with a small amplitude and to resonance circuit groups of different note names with a large amplitude, the output of the resonance circuit group of the same note name is prevented from significantly increasing compared with the outputs of the other resonance circuit groups; a resonance tone with good balance is thus obtained. To do so, in the configuration of Claim 11, the musical-tone generating means includes musical-tone producing means having a plurality of musical-tone producing channels, for producing and outputting a musical tone according to the musical-tone control information; multipliers equal in number to all note names, provided for each of the plurality of musical-tone producing channels, for multiplying a factor to adjust the amplitude of the musical tone according to the musical-tone control information, at least the factor of a multiplier having the same note name as the musical tone generated by the musical-tone generating means being different from those of the other multipliers; and adders provided corresponding to the plurality of resonance circuit groups of the resonance-tone generating means, respectively, for adding signals output from multipliers corresponding to identical note names for the plurality of musical-tone producing channels, among the outputs from the multipliers, and the outputs of the plurality of musical-tone producing channels are input to the multipliers of the channels, the outputs from multipliers corresponding to identical note names for the plurality of musical-tone producing channels are added in the adders provided corresponding to the plurality of resonance circuit groups of the resonance-tone generating means, respectively, and are sent and input to the respective resonance circuit groups, and the resonance-tone generating means produces a resonance tone and outputs it to the resonance-tone mixing means.

Because the design of each resonance circuit is the same as that in the first basic configuration, a description thereof is omitted (this also applies to the filter and multiplier provided there).

Describing the configuration of Claim 11 more concretely, it comprises, at least for outputting a musical tone: musical-tone control means including a plurality of operators, for generating operating information of the plurality of operators as musical-tone control information for specifying at least a sound-generation start, a sound-generation stop, a pitch, an operating intensity, and an operating amount; musical-tone generating means capable of simultaneously generating a plurality of musical tones according to the musical-tone control information; resonance-tone generating means including a plurality of resonance circuit groups and a plurality of input series corresponding to each of the plurality of resonance circuit groups, for adding and outputting resonance-tone outputs of the plurality of resonance circuit groups; and resonance-tone mixing means for multiplying a resonance tone generated by the resonance-tone generating means, by a predetermined degree according to the musical-tone control information, for adding the product to the input musical tone from the musical-tone generating means, and for outputting the sum, wherein the musical-tone generating means includes musical-tone producing means having a plurality of musical-tone producing channels, for producing and outputting a musical tone according to the musical-tone control information; multipliers equal in number to all note names, provided for each of the plurality of musical-tone producing channels, for multiplying a factor to adjust the amplitude of the musical tone according to the musical-tone control information, at least the factor of a multiplier having the same note name as the musical tone generated by the musical-tone generating means being different from those of the other multipliers; and adders provided corresponding to the plurality of resonance circuit groups of the resonance-tone generating means, respectively, for adding signals output from multipliers corresponding to identical note names for the plurality of musical-tone producing channels, among the outputs from the multipliers, and the outputs of the plurality of musical-tone producing channels are input to the multipliers of the channels, the outputs from multipliers corresponding to identical note names for the plurality of musical-tone producing channels are added in the adders provided corresponding to the plurality of resonance circuit groups of the resonance-tone generating means, and are sent and input to the respective resonance circuit groups, and the resonance-tone generating means produces a resonance tone and outputs it to the resonance-tone mixing means.

Each of the plurality of musical-tone generating channels of the musical-tone generating means may have multipliers equal in number (12 in a general musical instrument such as a piano) to the note names of the plurality of resonance circuit groups, the multiplication factors of the multipliers may be determined by a pitch in the musical-tone control information, the multiplication factor of one of the multipliers may be set to be smaller than the multiplication factors of the other multipliers, and all the multiplication factors of the other multipliers may be set to be equal (Claim 12).

The reason for inputting the waveform with a small amplitude to the resonance circuit group with the same note name as the generated musical tone and inputting it with a large amplitude to the resonance circuit groups with different note names is as follows.

When the frequency of a harmonic included in the musical tone input to a resonance circuit and the resonance frequency of the resonance circuit to which it is input are extremely close, in some times the resonance tone output from the resonance circuit becomes extremely large compared with a case where these frequencies are far from each other. Then, it is not possible to achieve volume balance between the output waveforms of resonance circuits whose resonance frequencies are far from the frequency of the input musical tone and the output waveform of a resonance circuit whose resonance frequency is extremely close to the frequency of the input musical tone; therefore, instead of sound like an actual resonance tone to be obtained, it sounds like a steady musical tone having that resonance frequency.

For example, FIG. 12 shows output waveforms (resonance tones) obtained when the waveforms of pitches C_3, D♯_3, and G_3 are input to a resonance circuit group _C shown in FIG. 27, which is described later. Similarly, FIG. 13 shows resonance tones of a resonance circuit group _G. The resonance tone obtained when C_3 is input to the resonance circuit group _C is significantly large, and similarly, the resonance tone obtained when G_3 is input to the resonance circuit group _G is significantly large. Under such circumstances, the sound of C_3 and G_3 are too large, and in the case of a piano, sound like that obtained when a damper pedal is operated cannot be obtained.

Therefore, when a musical tone is input to a resonance circuit whose resonance frequency is extremely close to the frequency thereof, it is necessary to reduce the amplitude of the musical tone compared with when it is input to the other resonance circuits.

According to the example described above, when the waveforms are input to the resonance circuit group _C, if the amplitude of only the C_3 waveform is reduced, the resonance tones of any pitches have substantially the same amplitude, as shown in FIG. 14. Similarly, when the waveforms are input to the resonance circuit group _G, if the amplitude of only the G_3 waveform is reduced, the resonance tones of any pitches also have substantially the same amplitude, as shown in FIG. 15. Therefore, in the case of a piano, it is possible to obtain sound like that obtained when an actual damper pedal is operated.

The number of input series of the resonance-tone generating means corresponds to the number of the note names of the resonance circuit groups (12 in a general musical instrument such as a piano), and the number of division series of output channels of musical-note dividing means is also the same (Claim 13). This is because the resonance circuit groups are provided corresponding to the note names (in a general musical instrument such as a piano, the twelve notes C, C♯, D, . . . , and B).

In each of the resonance circuit groups in the resonance-tone generating means, a plurality of resonance circuits corresponding to harmonics of the musical tone corresponding to the note name of the resonance circuit group is connected in parallel (Claim 14). This is a matter of course because the resonance circuits are provided corresponding to the harmonics of the note names.

In the second basic configuration also, as described above, the resonance circuits used in the resonance-tone generating means are used in common in the three basic configurations of the present application, and are designed so that one resonance circuit simulates the behavior of one harmonic of a corresponding pitch.

In other words, also in the second basic configuration, the resonance circuits have digital filters, and regarding filter coefficients used in each of these filters, an impulse response of the resonance circuit is defined to approximately simulate a vibration waveform of a harmonic, and the vibration waveform can be reproduced by a single-degree-of-freedom viscous damping model; model parameters for determining the behavior of the single-degree-of-freedom viscous damping model are defined as a mass, damped natural frequency, and damping factor, and given these, a viscosity coefficient and stiffness coefficient, serving as coefficients of an equation of motion of the model, are determined; the equation of motion of the model is subjected to a Laplace transform to obtain a transfer function formula in terms of "s", and the filter coefficients in terms of "z" are determined by substituting the determined viscosity coefficient, stiffness coefficient, and mass in the transfer function formula and performing a bilinear transformation; and the mass is defined as a desired value, the damped natural frequency is the frequency of the harmonic to be simulated, and the damping factor is defined as an exponent obtained when damping of the harmonic is approximated by an exponential function to determine the values of the filter coefficients (Claim 15).

Details of such a resonance circuit were given when one of the basic configurations of the present application is described, and therefore, a description thereof is omitted here.

The configuration of Claim 16 specifies a case in which multipliers are provided to as to be connected in series to respective digital filters in the resonance circuits; more concretely, it specifies that the multiplication factor of each of the multipliers is set to a value obtained by multiplying the amplitude ratio with a reference harmonic of a musical note that includes the harmonic corresponding to the multiplier, by a predetermined degree. Since a description of this has also been given in the paragraph for Claim 4, a description thereof is omitted here.

The configuration of Claim 17 specifies that, when the musical-tone generating means reads out a stored musical-tone waveform to generate the musical tone, the harmonic to be simulated is extracted from the stored musical-tone waveform. Since the configuration has been described in the paragraph for Claim 5 above, a description thereof is omitted here.

The configuration of Claim 18 specifies that, when the musical-tone generating means synthesizes a musical tone using predetermined musical-tone control information to generate the musical tone, the harmonic to be simulated is extracted from the output musical-tone waveform formed by synthesizing the musical tone using the predetermined musical-tone control information. Since the configuration has been described above in the paragraph for Claim 6, a description thereof is omitted here.

The configuration of Claim 19 specifies that the resonance frequency of one resonance circuit corresponds to one harmonic frequency, but when there are a plurality of harmonics whose harmonic frequencies are equal or whose harmonic frequencies are extremely close, one harmonic frequency is set as a representative frequency, and only one resonance circuit whose resonance frequency is defined by that harmonic frequency is used for the plurality of harmonics. Since the configuration has been described above in the paragraph for Claim 7, a description thereof is omitted here.

The configuration of Claim 20 specifies that the resonance-tone generating means has a configuration in which an output thereof is multiplied by a predetermined degree, the product is added to the input musical tone, and the sum is input again to this resonance-tone generating means as feedback. Since the configuration of Claim 20 has been described in the paragraph for Claim 9 described above, a description thereof is omitted here.

The configuration of Claim 21 specifies that the resonance-tone generating means has a configuration in which an output thereof is multiplied by a predetermined degree, the product is added to the input musical tone, and the sum is input again to this resonance-tone generating means as feedback, and a delay circuit for delaying the output of the resonance-tone generating means by a predetermined time and/or a filter for changing the amplitude-frequency characteristic of the output of the resonance-tone generating means is provided in a feedback path of the configuration. Since the configuration of Claim 21 has been described above in the paragraph for Claim 10, a description thereof is omitted here.

The configuration of an electronic musical instrument according to Claim 22, which forms the core of the third basic configuration of the present application, will be described. With this configuration, as described above, by storing in advance, in resonance-tone-waveform storing means, resonance tones obtained by inputting musical-tone signals that can be generated, to a plurality of resonance circuits corresponding to harmonics of musical tones and by reading out the waveform of a resonance tone in response to a performance (operating information of operators), sound like that during a performance while a damper pedal is depressed in the case of a piano is reproduced.

The resonance circuits corresponding to harmonics of musical tones are basically the same as in the two basic configurations described above; they are designed by determining the harmonic frequencies and damping factors by analyzing the original waveforms (the original collected waveforms when using the method of reading out a musical-tone waveform from waveform storing means) and by using these as design parameters. The resonance circuits in this third configuration are necessary for storing the resonance-tone waveforms in the resonance-tone-waveform storing means. Unlike the other two basic configurations, once the resonance-tone waveforms have been stored, the electronic musical instrument does not need the resonance circuits unless a new resonance tone is stored.

Because the design of each resonance circuit is the same as in the first and second configurations described above, a description thereof is omitted (the same also applies to the filter and multiplier provided therein).

Describing the configuration of Claim 22 more concretely, it includes at least for outputting a musical tone: musical-tone control means including a plurality of operators, for generating operating information of the plurality of operators as musical-tone control information for specifying at least a sound-generation start, a sound-generation stop, a pitch, an operating intensity, and an operating amount; musical-tone generating means capable of simultaneously generating a plurality of musical tones according to the musical-tone control information; resonance-tone-waveform storing means having stored resonance-tone waveforms; resonance-tone generating means capable of simultaneously generating a plurality of resonance tones by reading out the resonance-tone waveforms from the resonance-tone-waveform storing means according to the musical-tone control information; and resonance-tone mixing means for multiplying a resonance tone generated by the resonance-tone generating means, by a predetermined degree according to the musical-tone control information, for adding the product to an input musical tone from the musical-tone generating means, and for outputting the sum.

As described above, in the third basic configuration of the present application, the resonance circuits are necessary to store the resonance tone waveforms in the resonance-tone-waveform storing means. Therefore, as shown in an embodiment described later, the resonance-tone waveforms stored in the resonance-tone-waveform storing means are formed by storing in advance output waveforms obtained by inputting a musical tone to a configuration (a configuration required for creating the resonance-tone waveforms stored in the resonance-tone-waveform storing means used in this electronic musical instrument) in which a plurality of resonance circuits (each has a filter and, in some cases, a multiplier is directly connected thereto) corresponding to harmonics of musical tones that can be generated is connected in parallel (Claim 23).

The resonance circuits described above output resonance tones corresponding to the input musical tone, and as described above, the outputs are eventually stored in the resonance-tone-waveform storing means.

When each of the resonance circuits is formed of a filter and a multiplier connected thereafter, the output level thereof (the multiplication factor of the multiplier) is changed according to a musical tone input when the resonance tone is created.

At this time, the amplitude of the output waveform of a resonance circuit whose resonance frequency is equal to the frequency of a harmonic included in the input musical tone is preferably made smaller than the output waveforms of the other resonance circuits.

In other words, each filter is a resonance circuit having a resonance frequency substantially equal to a harmonic of the input musical tone. Therefore, when a harmonic of a frequency equal to that resonance frequency is input, the output amplitude of that resonance circuit becomes much larger than the outputs of the other resonance circuits.

Therefore, when a certain musical tone is input, the amplitude of a resonance circuit having the same resonance frequency as the frequency of a harmonic included in that musical tone becomes much larger compared with the other resonance circuits. When the outputs of all resonance circuits are added under this condition, it sounds like the input musical tone, and in the case of a piano, it is not possible to obtain a desired resonance tone like that during a performance when a damper pedal is depressed.

Therefore, it is necessary to reduce the multiplication factor of the multiplier in a resonance circuit having a resonance frequency equal to the frequency of a harmonic included in the input musical tone compared with the multiplication factors of the multipliers in the other resonance circuits.

For example, "a" in FIG. 16 indicates the total of the outputs obtained when the musical tone F_6 is input to a plurality of resonance circuits having resonance frequencies of harmonics included in C_6. Similarly, "b" indicates the total of the outputs obtained when the musical tone F_6 is input to a plurality of resonance circuits having resonance frequencies of harmonics included in D♯_6. Similarly, "c" indicates the total of the outputs obtained when the musical tone F_6 is input to a plurality of resonance circuits having resonance frequencies of harmonics included in F_6 (filters filterF6-1 to filterF6-N69 in FIG. 31, described later).

The levels of the resonance circuits at this time (the multiplication factors of the multipliers directly after the resonance circuits) are all 1. At this time, the amplitude of "c" is much larger than "a" and "b". Therefore, even when these resonance tones are added, it sounds like the musical tone F_6.

FIG. 17 shows a case in which the output levels of the resonance circuit for C_6 and the resonance circuit for D♯_6 are 1, and the output level of the resonance circuit for F_6 (multipliers M3-F6-1 to M3-F6-N69 in FIG. 31) is 0.1.

Then, the output amplitude of the resonance circuit for F_6 is also substantially the same as the outputs of the other resonance circuits.

If these resonance tones are added, in the case of a piano, desired sound like that during a performance while a damper pedal is depressed is obtained (here, for the sake of explanation, three tones are used, but actually the outputs of all resonance circuits are added).

In the third basic configuration, as described above, the resonance circuits are used for creating resonance tones to be stored in the resonance-tone-waveform storing means. The third basic configuration differs in this point from the two basic configurations described above; however, the configuration of the resonance circuits themselves that are used in this basic configuration is the same as that used in the resonance-tone generating means in the two basic configurations described above, and one resonance circuit is designed to simulate the behavior of one harmonic of a corresponding pitch.

In other words, in the third basic configuration also, the resonance circuits have digital filters, and regarding filter coefficients used in each of these filters, an impulse response of the resonance circuit is defined to approximately simulate a vibration waveform of a harmonic, and the vibration waveform can be reproduced by a single-degree-of-freedom viscous damping model; model parameters for determining the behavior of the single-degree-of-freedom viscous damping model are defined as a mass, damped natural frequency, and damping factor, and given these, a viscosity coefficient and stiffness coefficient, serving as coefficients of an equation of motion of the model, are determined; the equation of motion of the model is subjected to a Laplace transform to obtain a transfer function formula in terms of "s", and the filter coefficients in terms of "z" are determined by substituting the determined viscosity coefficient, stiffness coefficient, and mass in the transfer function formula and performing a bilinear transformation; and the mass is defined as a desired value, the damped natural frequency is the frequency of the harmonic to be simulated, and the damping factor is defined as an exponent obtained when damping of the harmonic is approximated by an exponential function to determine the values of the filter coefficients (Claim 24).

Details of such a resonance circuit were described in the description of one basic configuration of the present application, and therefore, a description thereof is omitted here.

The configuration of Claim 25 specifies a configuration in which multipliers are provided so as to be respectively connected in series to the digital filters of the resonance circuits; more concretely, it specifies that the multiplication factor of each of the multipliers is set to a value obtained by multiplying the amplitude ratio with a reference harmonic of a musical tone that includes the harmonic corresponding to the multiplier, by a predetermined degree. Since a description of this has been also given in the paragraphs for Claims 4 and 16 above, a description thereof is omitted here.

The configuration of Claim 26 specifies that, when the musical-tone generating means reads out a stored musical-tone waveform to generate the musical tone, the harmonic to be simulated is extracted from the stored musical-tone waveform. Since the configuration has been described above in the paragraphs for Claims 5 and 17, a description thereof is omitted here.

The configuration of Claim 27 specifies that, when the musical-tone generating means synthesizes a musical tone using predetermined musical-tone control information to generate the musical tone, the harmonic to be simulated is extracted from the output musical-tone waveform formed by synthesizing the musical tone using the predetermined musical-tone control information. Since the configuration has been described above in the paragraphs for Claims 6 and 18, a description thereof is omitted here.

The configuration of Claim 28 specifies that the resonance-tone generating means has a configuration in which an output thereof is multiplied by a predetermined degree, the product is added to the input musical tone, and the sum is input again to this resonance-tone generating means as feedback. Since the configuration of Claim 28 has been described above in the paragraphs for Claims 9 and 20, a description thereof is omitted here.

The configuration of Claim 29 specifies that the resonance-tone generating means has a configuration in which an output thereof is multiplied by a predetermined degree, the product is added to the input musical tone, and the sum is input again to this resonance-tone generating means as feedback, and a delay circuit for delaying the output of the resonance-tone generating means by a predetermined time and/or a filter for changing the amplitude-frequency characteristic of the output of the resonance-tone generating means is provided in a feedback path of the configuration. Since the configuration of claim 29 has been described above in the paragraphs for Claims 10 and 21, a description thereof is omitted here.

ADVANTAGES OF THE INVENTION

According to electronic musical instruments described in Claim 1 to Claim 29 of the present invention, an advantage is obtained that a resonance tone in which harmonic levels are finely adjusted easily and which is close to actual resonance can be generated with a simple configuration.

DESCRIPTION OF REFERENCE NUMERALS

1: MUSICAL-TONE CONTROL MEANS
2: MUSICAL-TONE GENERATING MEANS
3: RESONANCE-TONE GENERATING MEANS
4: RESONANCE-TONE MIXING MEANS
5: RESONANCE-TONE CALCULATING MEANS
20: MUSICAL-TONE PRODUCING MEANS
200: SYSTEM BUS
201: CPU
202: ROM
203: RAM
204: KEYBOARD
205: DAMPER PEDAL
206: SOUND SOURCE
207: DSP
208: WAVEFORM MEMORY
209: ACOUSTIC SYSTEM

BEST MODE FOR CARRYING OUT THE INVENTION

Embodiments of the present invention will be described below, taking an electronic piano as an example, together with example illustrations.

First Embodiment

Figure 18:
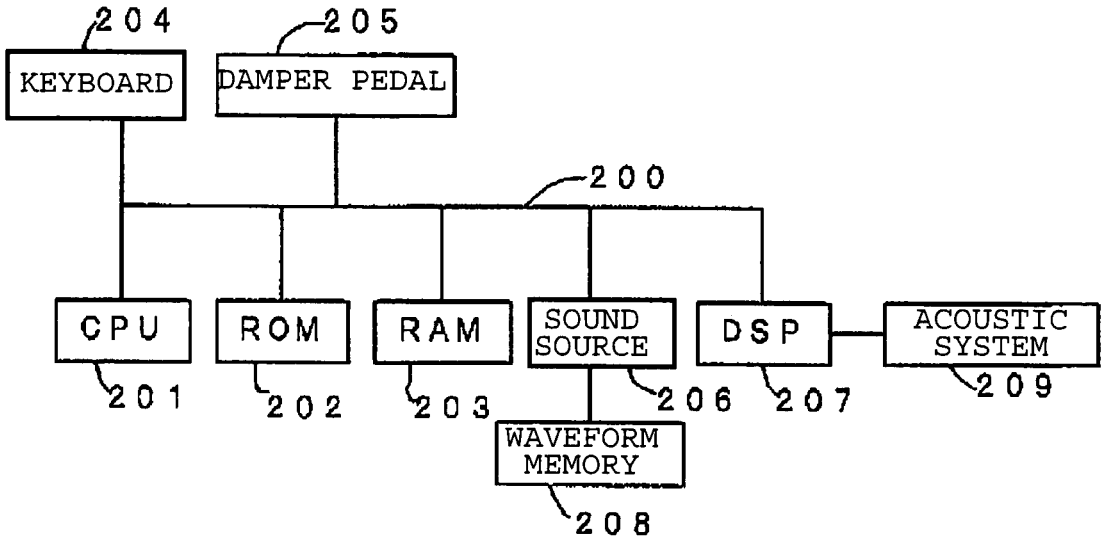
FIG. 18 is a diagram showing the hardware configuration of the electronic piano according to a first embodiment of the present invention.
Figure 19:
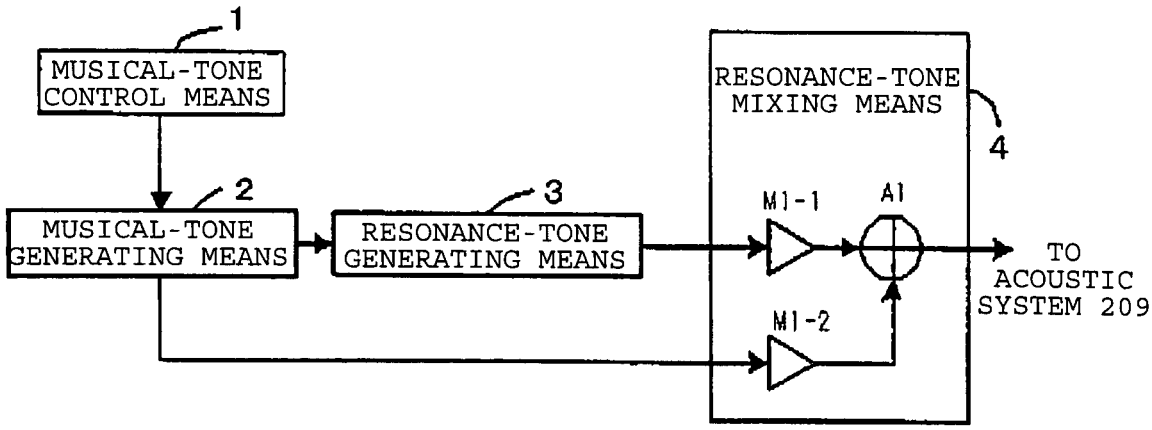
FIG. 19 is a functional block diagram showing a basic configuration of the first embodiment applied to the electronic piano.

FIG. 18 is an illustration showing the hardware configuration of an electronic piano according to the present invention, and FIG. 19 is a functional block diagram showing the best mode configuration of the first basic configuration described above, which is applied to this electronic piano.

As shown in FIG. 18, the electronic piano is formed of a CPU 201, a ROM 202, a RAM 203, a keyboard 204, a damper pedal 205, a sound source 206, and a digital signal processor (DSP) 207, which are connected to each other via a system bus 200. The system bus 200 is used for transmitting and receiving address signals, data signals, control signals, and so forth (an address bus, a data bus, or a signal bus formed of control signal lines).

The CPU 201 is a central processing unit that is responsible for controlling the electronic piano according to a program stored in the ROM 202, described later. It controls the keyboard 204 and the damper pedal 205 to scan the operational state or the like of keys on the keyboard 204 and the damper pedal 205, and using operating information such as keypress data [key on/off, key ID information (key number etc.), key touch response: key data] according to key presses and key releases of the keyboard 204 and the degree-of-depression of the damper pedal 205 as musical-tone control information, it performs assignment processing to the sound source 206 and the DSP 207 and generates a desired musical-tone signal using an acoustic system 209 connected to the output side of the DSP 207.

The ROM 202 is a read-only memory, which stores various parameter data which the CPU 201 refers to when generating musical tones, in addition to the program for the CPU 201, described above.

The RAM 203 is a readable and writable memory, which temporarily stores data of processing steps during processing of the program in the CPU 201, and which stores parameter data. Registers, counters, and flag functions, and so on are defined in this RAM 203 as required.

The keyboard 204 is a keyboard circuit having 88 keys, from A_0 to C_8; keypress data issued from the circuit is detected by a keyboard scanning circuit, which is not shown in the figure, and the detected keypress data is output. In other words, respective 2-terminal switches are provided in the 88-key keyboard 204. When it is determined that any key on the keyboard 204 is pressed beyond a predetermined depth, a keypress signal for pitch data (key number) of that key is generated and a velocity is generated from a traveling speed at the two-terminal switch, and these are sent as keypress data to the keyboard scanning circuit. Upon receiving the keypress data from the two-terminal switch, the keyboard scan circuit sends it to the CPU 201.

The keypress data from the keyboard scanning circuit is sent to portions of the sound source 206 corresponding to respective channels by the CPU 201.

The damper pedal 205 has substantially the same configuration as a pedal installed at the bottom of an actual piano. Here, however, it includes a variable resistor, and using this resistor, it is configured to detect a change in voltage or the like as the degree-of-depression of the pedal. The pedal degree-of-depression data detected with this configuration is sent to the CPU 201 and the DSP 207. When the CPU 201 receives this data, it sets a resonance setting flag in the RAM 203 to 1. Naturally, in the absence of any depression, the degree-of-depressing sent to the CPU 201 from the detection configuration described above is 0, and the resonance setting flag in the RAM 203 is set to 0.

The sound source 206 is designed as a specialized LSI, generates a readout address according to the key played on the keyboard 204 and reads out source data (piano tone) from a waveform memory 208, which corresponds to musical-tone waveform storing means in musical-tone generating means of the present application. Then, after subjecting the source data to interpolation processing, it multiplies the envelope of each tone generated in the same circuit, accumulates waveform data of respective tones for set channels, and generates a musical tone signal to the outside. In contrast to the PCM sound source configuration described here, the sound source 206 may be configured to generate musical tones using another FM sound-source method, a sine-wave additive method, or a subtractive method.

Based on a command from the CPU 201 which detects the status of the resonance setting flag in the RAM 203, when the resonance setting flag is set to 1, the DSP 207 is configured to add an acoustic effect by generating a resonance tone from a musical tone output from the sound source 206 and adding the resonance tone to the musical tone. The level of resonance tone added is directly assigned from the above-described detector structure (variable resistor) of the damper pedal 205 using the degree-of-depression of the damper pedal 205 as musical-tone control information.

The musical-tone signal (when the damper pedal 205 is operated, the resonance tone is also added thereto) output from the sound source 206 is input to a D/A conversion circuit (not shown in the figure) in the acoustic system 209, where it is converted from digital to analog, has noise removed therefrom in an analog signal processor (not shown in the figure), is amplified with an amplifier (not shown in the figure), and is output from a speaker (not shown in the figure) as a musical tone.

FIG. 19 shows functional blocks at the musical tone output side of the electronic piano having the configuration described above. As shown in this figure, it is configured of musical-tone control means 1, musical-tone generating means 2, resonance-tone generating means 3, and resonance-tone mixing means 4.

Of these, the musical-tone control means 1 is formed of the keyboard 204, the damper pedal 205, the CPU 201, the ROM 202, and the RAM 203. As described above, the CPU 201 detects the operation of the keyboard 204 and the damper pedal 205 and stores operating information thereof as musical-tone control information. The musical-tone control information comprises the operated key (its number or the like=the pitch), the status of the key (on/off), the strength with which the key is operated (velocity data), the degree-of-depression of the damper pedal 205, and so forth. By sending this musical-tone control information to the sound source 206, the CPU 201 instructs the generation/stopping of a musical tone. It is also sent to the DSP 207 to write (overwrite) coefficients related to the operation of the resonance-tone generating means 3 and the resonance-tone mixing means 4, which will be described later. A program describing the procedure for the CPU 201 to carry out such operations is stored in the ROM 202. The coefficients are stored in association with the musical-tone control information. (They may also be stored with no association.)

The musical-tone generating means 2 is formed of the sound source 206 and the waveform memory 208, and has a configuration which is capable of simultaneously generating a plurality of musical tones based on the musical-tone control information.

The resonance-tone generating means 3 is formed of the DSP 207, and is configured to include resonance circuits equal in number to harmonic signals of the musical tone signals that can be generated, as described later, such that resonance tones are generated by the resonance circuits, using the musical tone generated by the musical-tone generating means 2 as an input signal to each resonance circuit. Details thereof will be described later with reference to FIG. 20.

The resonance-tone mixing means 4 is also formed of the DSP 207, and has a configuration for subjecting the resonance tone generated by the resonance-tone generating means 3 to multiplication by a predetermined degree, based on the musical-tone control information, adding the product to the input musical tone from the musical-tone generating means 2, and outputting the sum. As shown in FIG. 19, the configuration of this embodiment includes a multiplier M1-1 connected to the output side of the resonance-tone generating means 3, a multiplier M1-2 connected to the output side of the musical-tone generating means 2, and an adder A1 for adding the outputs of the two multipliers M1-1 and M1-2, which are formed of the DSP 207.

The multiplier M1-1 is configured to multiply the amplitude of the resonance tone from the resonance-tone generating means 3 by a predetermined factor. The multiplication factor is determined according to the degree-of-depression of the damper pedal 205 in the musical-tone control information that the musical-tone control means 1 produces.

The multiplier M1-2 is configured to multiply the amplitude of the musical tone from the musical-tone generating means 2 by a predetermined number.

Figure 20:
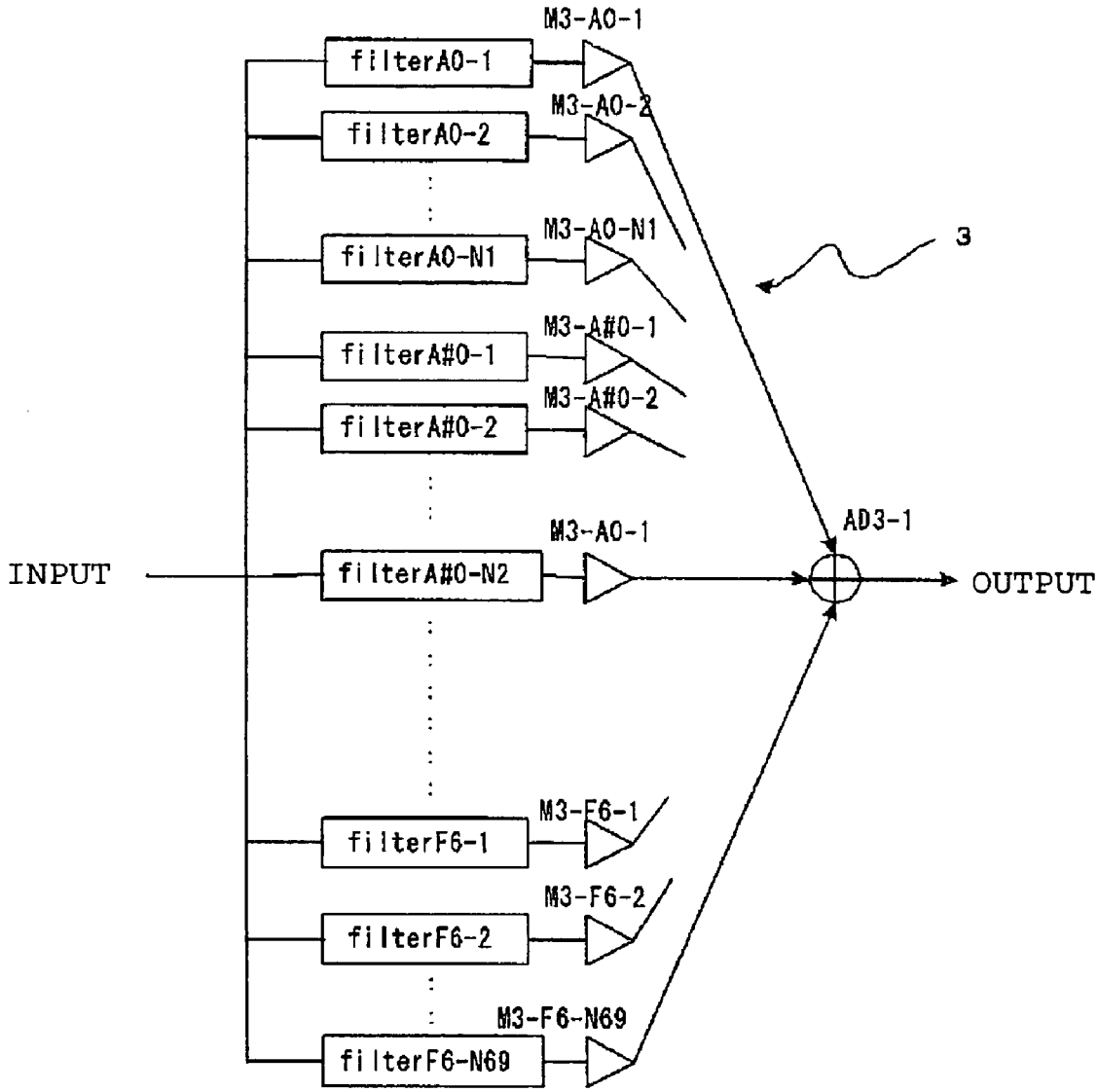
FIG. 20 is a diagram showing a functional block of resonance-tone generating means 3, which is formed of a DSP.

Next, the resonance-tone generating means 3, which is formed of the DSP 207, will be described with reference to FIG. 20.

As shown in this figure, the resonance-tone generating means 3 is configured to have resonance circuits for tones 1 to 69 corresponding to one pitch (key), each resonance circuit having a filter and a multiplier connected in series and having a resonance frequency corresponding to the frequency of one harmonic of the pitch. Therefore, for a single input musical tone, 69 resonance tones are created with these resonance circuits and are added with an adder AD3-1 to output a resonance tone of the single musical tone.

Described in more detail, a single filter and the multiplier connected thereto in the figure form, as one set, a resonance circuit having a resonance frequency corresponding to the frequency of one harmonic of one pitch (key). In this embodiment, a filter filterA0-1 and a multiplier M3-A0-1 form a resonance circuit having a resonance frequency corresponding to the frequency of the first harmonic of the pitch A_0; similarly, a filter filterA0-2 and a multiplier M3-A0-2 correspond to the second harmonic of the pitch A_0, and a filter filterA0-N and a multiplier M3-A0-N form a resonance circuit having a resonance frequency corresponding to the highest-order harmonic of A_0. In the same way, a filter filterA♯0-1 and a multiplier M3-A♯0-1, a filter filterA♯0-2 and a multiplier M3-A♯0-2, and a filter filterA♯0-N2 and a multiplier M3-A♯0-N2 form resonance circuits having resonance frequencies corresponding to the first harmonic, the second harmonics, and the highest-order harmonic of a pitch A♯_0, respectively. In addition, AD3-1 is an adder for adding the outputs of all of the resonance circuits.

The same thing applies to the filters filterF6, . . . . In this embodiment, resonance circuits corresponding to all harmonics at all pitches from A_0 to F_6 are connected in parallel. The reason why the filters correspond only to A0 to F6 in this embodiment is that, in a piano, the pitches that are damped by the damper pedal 205 are the 69 keys from A_0 to F_6. If necessary, filters corresponding to each harmonic of F♯_6 to C_8 may also be provided. When applied to an instrument other than a piano, it is not necessary to stick to the range A_0 to F_6.

M3-A0-1 to M3-F6-N69 are multipliers of the resonance circuits. By setting desired multiplication factors thereof, it is possible to freely set the tonal quality of each resonance tone.

Since the design of the resonance circuits has been described above, a description thereof is omitted here.

The above is a description of the configuration of the first embodiment according to the present invention. The operation of this configuration will be described below, following the flow thereof.

First, when a key 204 is pressed, musical-tone control information, such as a pitch corresponding to that key, an intensity corresponding to the keypress velocity (velocity data), and so forth, is generated by the musical-tone control means 1 and is sent to the musical-tone generating means 2.

When a plurality of keys 204 are pressed, musical-tone control information, such as a plurality of pitches and intensities corresponding thereto, are sent to the musical-tone generating means 2 from the musical-tone control means 1.

The musical-tone generating means 2 reads out (reads out from the waveform memory 208) a musical tone corresponding to that musical-tone information and sends it to the resonance-tone generating means 3 and the resonance-tone mixing means 4.

If a plurality of musical tones are generated, those musical tones are added and sent to the resonance-tone generating means 3 and the resonance-tone mixing means 4. For example, when the C_3 and G_3 keys 204 are strongly operated, a musical-tone waveform corresponding to strongly striking C_3 and a musical-tone waveform corresponding to strongly striking G_3 are read out, and the waveform formed by adding them together is sent to the resonance-tone generating means 3 and the resonance-tone mixing means 4 as a musical tone.

The resonance-tone generating means 3 generates resonance tones having large amplitudes from the resonance circuits having resonance frequencies corresponding to the harmonic frequencies of the input signal and generates resonance tones having small amplitudes from the resonance circuits having different resonance frequencies from the harmonic frequencies of the signal. In other words, the closer any harmonic frequency and the resonance frequency are, the larger the output amplitude of that resonance circuit, and the further apart they are, the smaller the output amplitude of that resonance circuit. For example, when a waveform formed by adding the waveforms corresponding to strongly striking C_3 and G_3 is input, resonance tones having large amplitudes are generated from the resonance circuits whose resonance frequencies are close to the harmonic frequencies of the waveform corresponding to strongly striking C_3 and G_3, and resonance tones having small amplitudes are generated from the resonance circuits whose resonance frequencies are far from the harmonic frequencies of the waveform corresponding to strongly striking C_3 and G_3. Then, all resonance tones generated by the resonance circuits are added by the adder AD3-1 and output to the resonance-tone mixing means 4.

In the resonance-tone mixing means 4, the resonance tone subjected to multiplication by the predetermined factor in the multiplier M1-1 and the musical tone subjected to multiplication by the predetermined number in the multiplier M1-2 are added at the adder A1 and output to the acoustic system 209. The multiplication factor of the multiplier M1-1 at this time depends on the musical-tone control information. The musical-tone control means 1 detects the degree-of-depression of the damper pedal 205 and changes the value of the multiplication factor of the multiplier M1-1 each time the damper pedal 205 is operated. As the degree-of-depression increases, the multiplication factor increases, and as the degree-of-depression decreases, the multiplication factor decreases. It is also possible to set the multiplication factor to 0 from nil degree-of-depression up to a predetermined degree-of-depression, and to set it to a certain fixed value when the predetermined degree-of-depression is exceeded.

The acoustic system 209, which has the configuration described above, acoustically emits the output sent from the resonance-tone mixing means 4.

Figure 21:
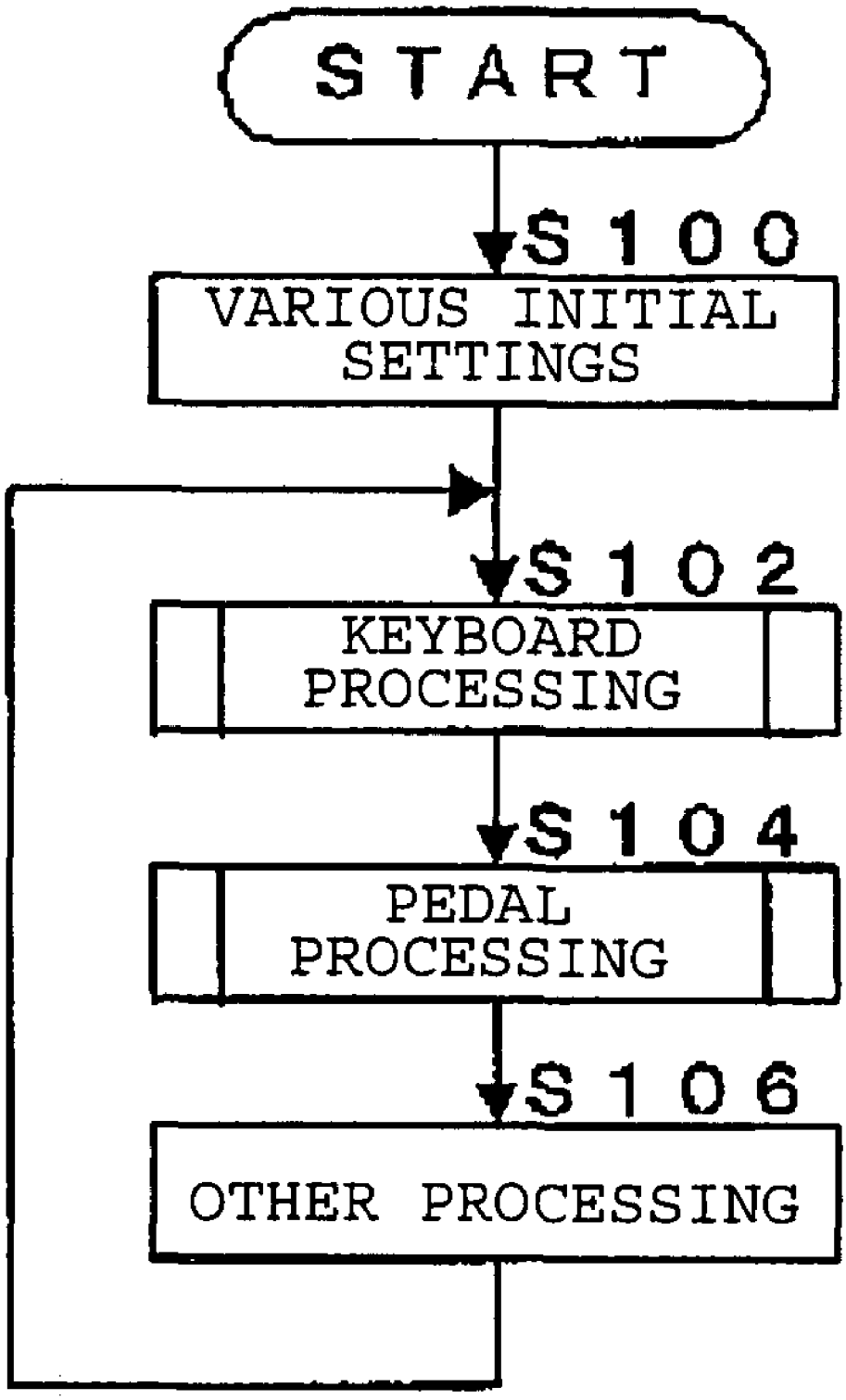
FIG. 21 is a flowchart showing a main processing flow of the electronic piano.
Figure 22:
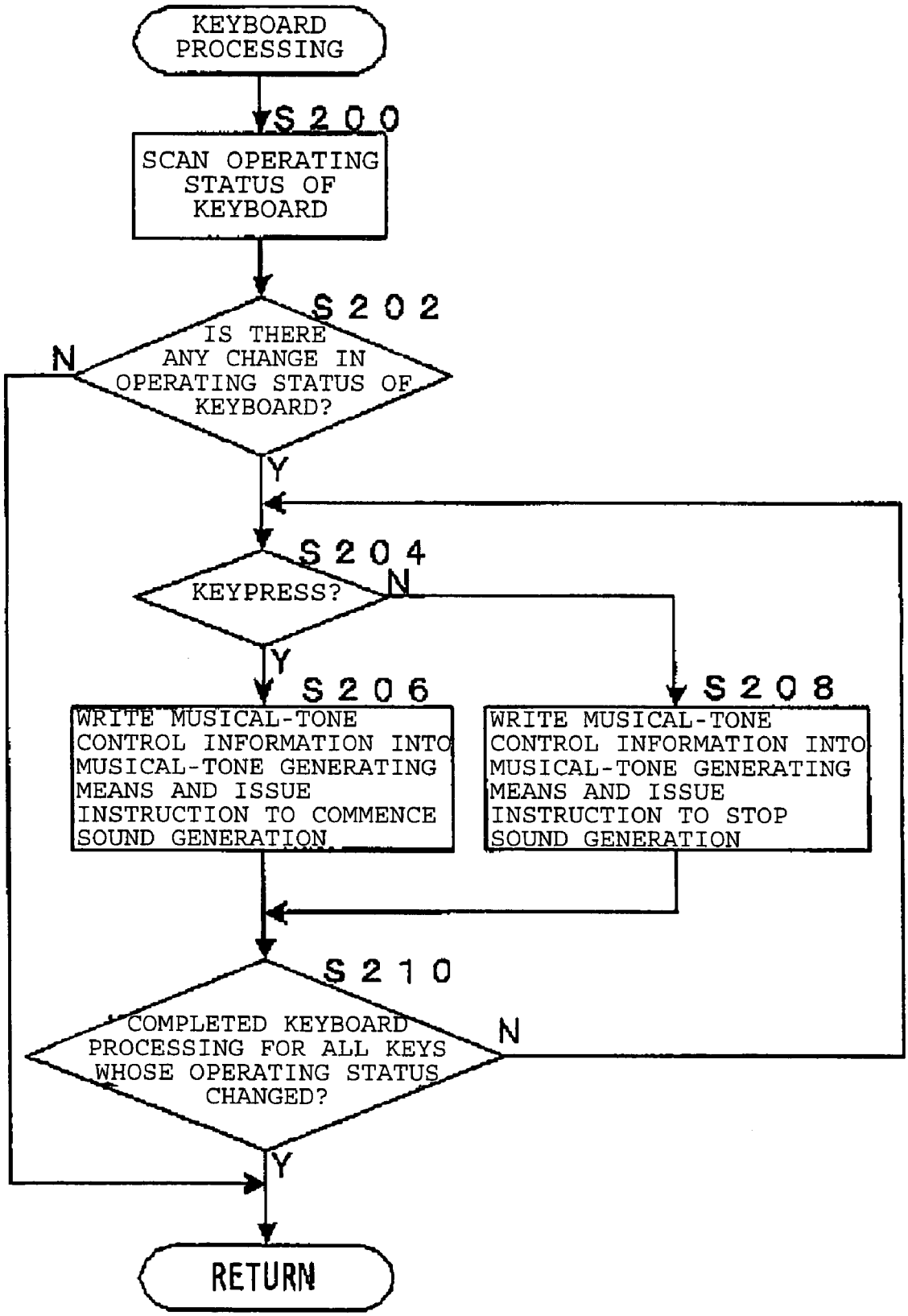
FIG. 22 is a flowchart of a keyboard processing flow in this embodiment.
Figure 23:
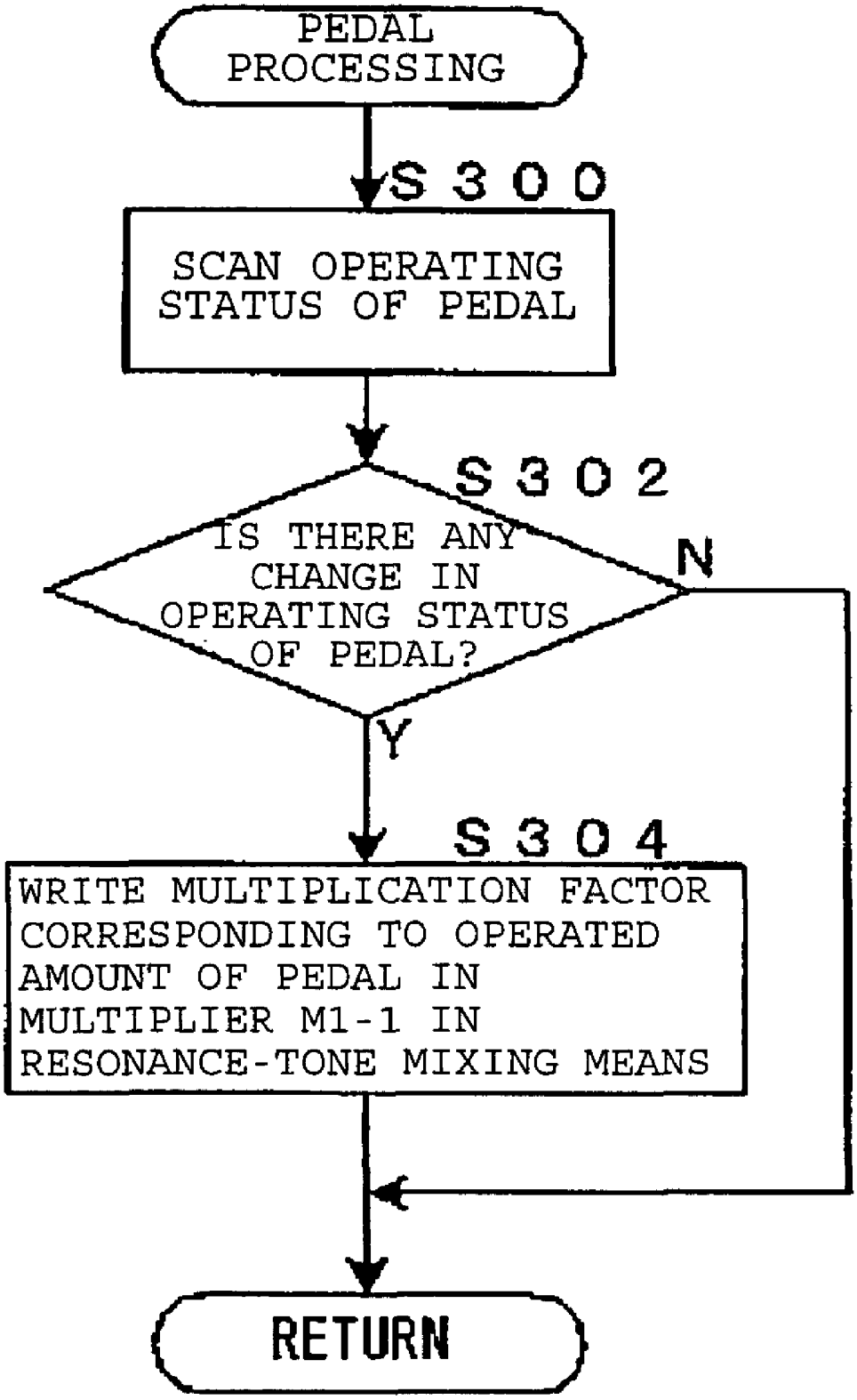
FIG. 23 is a flowchart of a pedal processing flow in this embodiment.

FIGS. 21 to 23 show processing flows of the operation of the electronic piano having the configuration of the embodiment described above.

FIG. 21 shows a main processing flow of the electronic piano. As shown in this figure, when the power supply of the electronic piano is turned on, each component of the electronic piano is initialized (step S100). Then, the operating status of the keyboard 204 is scanned, and keyboard processing for carrying out various types of processing according to the key-press/key-release status thereof is performed (step S102). Next, the operating status of the damper pedal 205 is scanned, and pedal processing for carrying out various types of processing according to the degree-of-depression thereof is performed (step S104). Other processing (for example, panel operation processing) is then performed (step S106).

FIG. 22 is a processing flowchart showing the flow of keyboard processing in step S102 described above. As shown in this figure, the operating status of the keyboard 204 is scanned (step S200). It is then checked whether or not there is any change in the operating status of the keyboard 204 (step S202).

If there is no change in the operating status of the keyboard 204 (No in step S202), the keyboard processing ends, and the processing proceeds to the pedal processing in the main flow. On the other hand, if there is a change in the operating status of the keyboard 204 (Yes in step S202), it is checked whether or not the operation corresponding to that change is a keypress (step S204).

If it is a keypress (Yes in step S204), the musical-tone control information is written in the musical-tone generating means 2, and a sound-generation start instruction is output (step S206).

If, on the other hand, it is a key release (No in step S204), the musical-tone control information is written in the musical-tone generating means 2, and a sound-generation stop instruction is output (step S208).

Then, it is checked whether or not the processing for all keys whose operating status has changed has been completed (step S210).

If the processing for all keys whose operating status has changed has not been completed (No in step S210), the processing returns to step S204 described above. On the other hand, if the processing for all keys whose operating status has changed has been completed (Yes in step S210), the keyboard processing ends, and the processing proceeds to the pedal processing in the main flow.

FIG. 23 is a processing flowchart showing the pedal processing in step S104 described above. As shown in this figure, the operating status of the damper pedal 205 is scanned (step S300). Then, it is checked whether or not there is any change in the operating status of the damper pedal 205 (step S302).

If there is no change in the operating status of the damper pedal 205 (No in step S302), the pedal processing ends, and the processing proceeds to the other processing in the main flow. On the other hand, if there is a change in the operating status of the damper pedal 205 (Yes in step S302), a multiplication factor corresponding to the degree-of-depression of the pedal is written in the multiplier M1-1 of the resonance-tone mixing means (step S304). The pedal processing then ends, and the processing proceeds to the other processing in the main flow.

Figure 1:
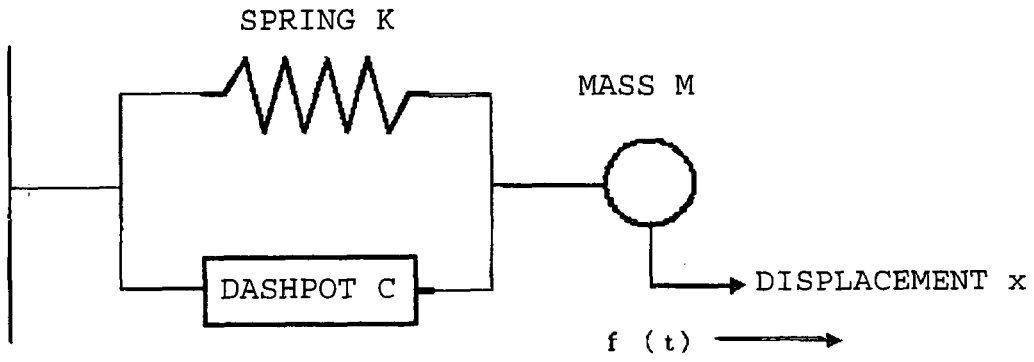
FIG. 1 is a model diagram showing a single-degree-of-freedom viscous damping model.
Figure 2:
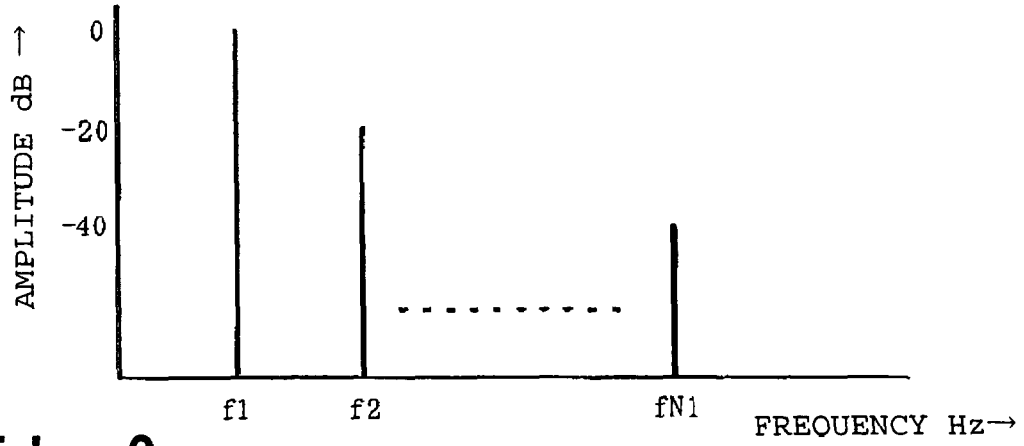
FIG. 2 is a graph showing an amplitude-frequency characteristic obtained by FFT analysis.
Figure 3:
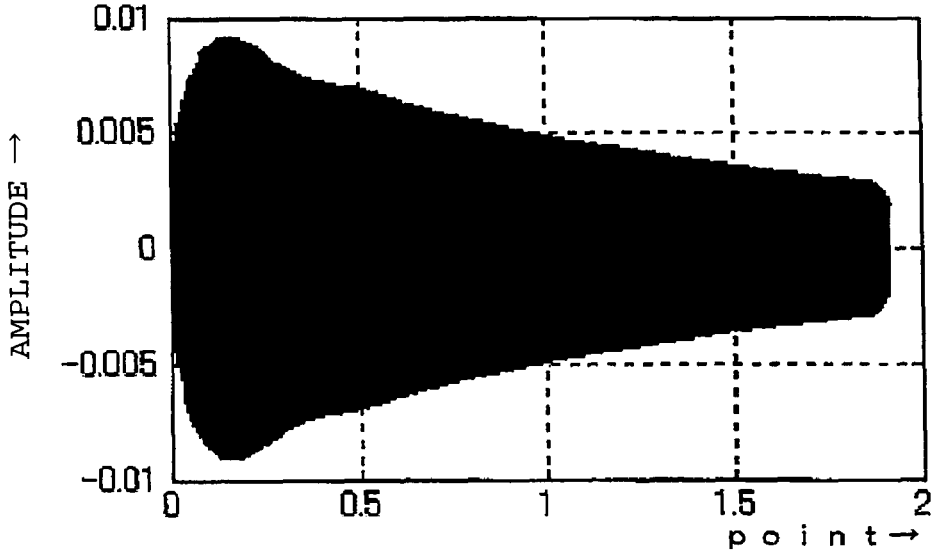
FIG. 3 is a waveform diagram showing the first harmonic of A_0.
Figure 4:
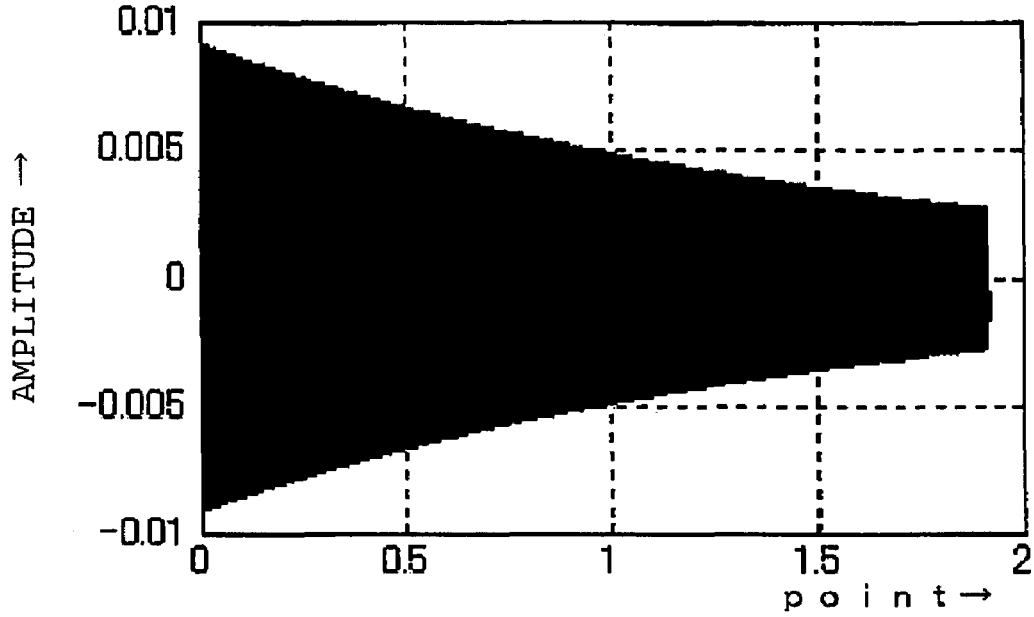
FIG. 4 is a waveform diagram showing an approximated waveform of the first harmonic of A_0.
Figure 5:
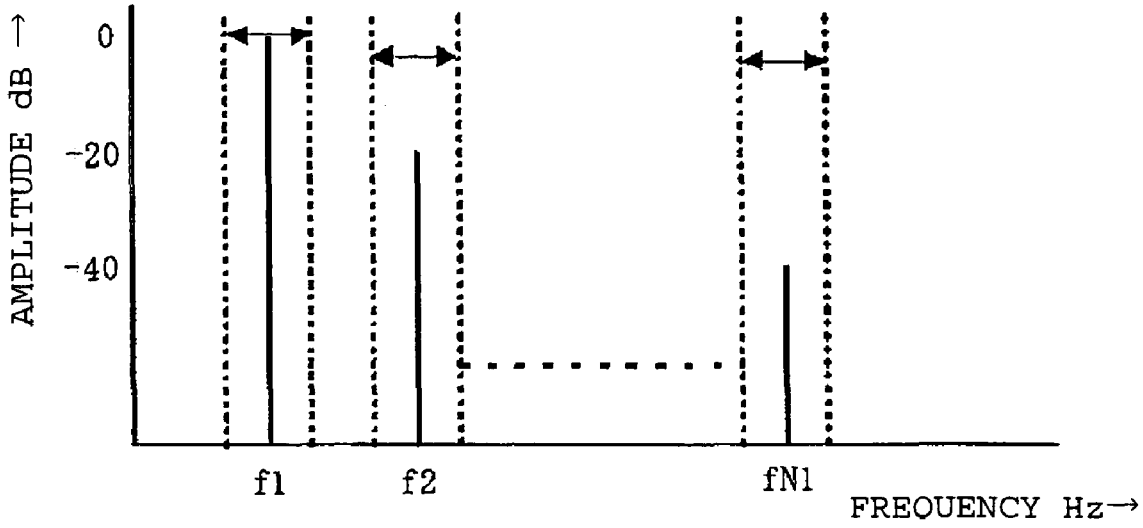
FIG. 5 is a graph showing example bandwidths for extracting harmonics.
Figure 6:
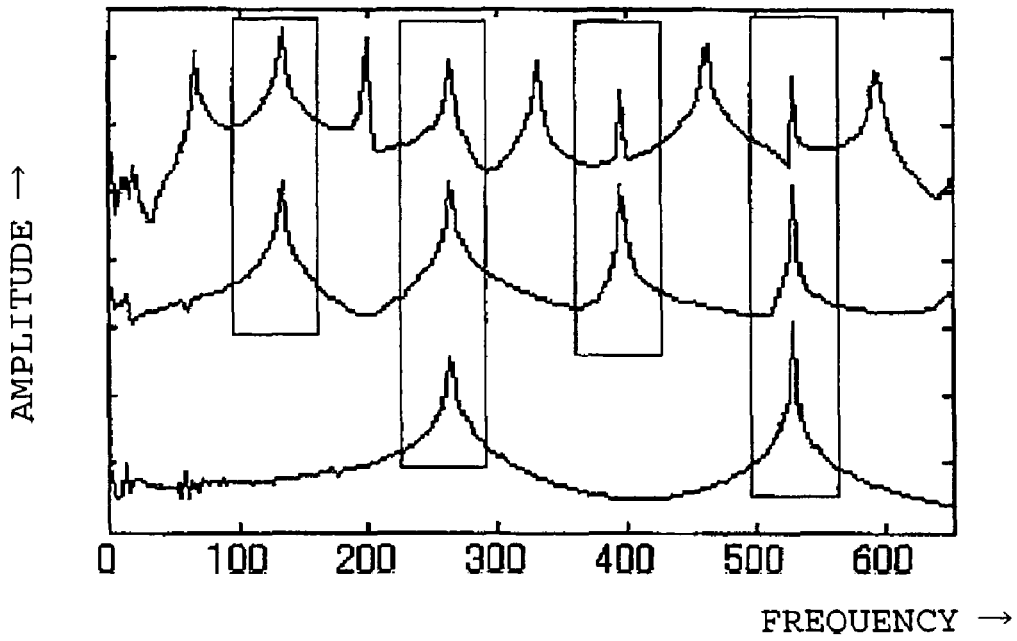
FIG. 6 is a graph showing amplitude-frequency characteristics for harmonics of C_2, C_3, and C_4 by FFT analysis.
Figure 7:
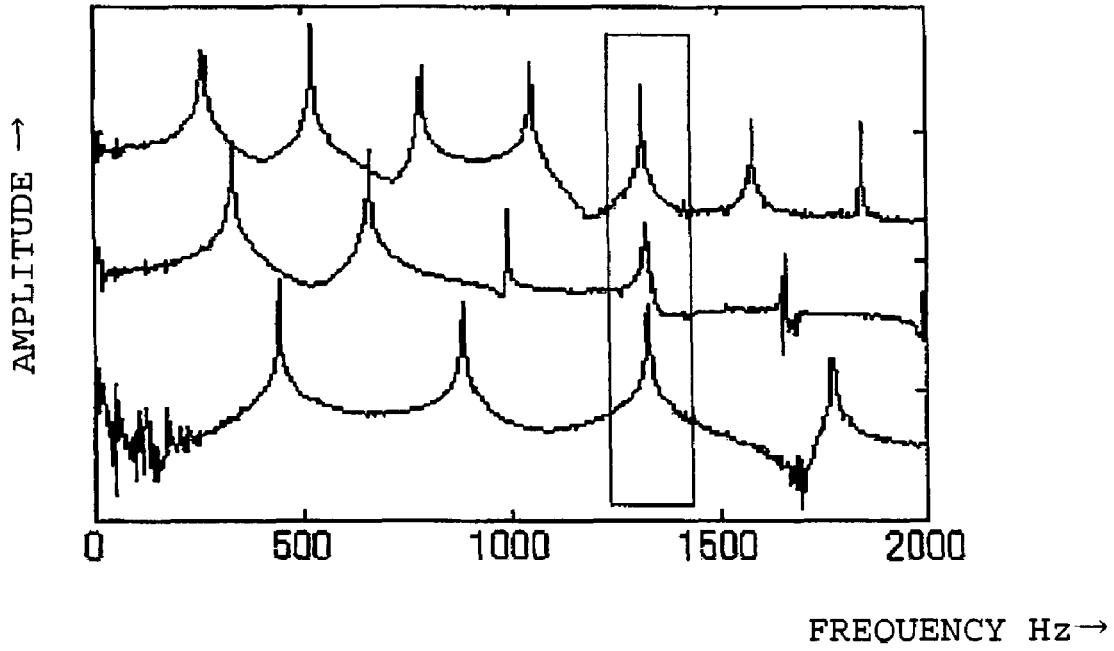
FIG. 7 is a graph showing amplitude-frequency characteristics for harmonics of C_4, E_4, and A_4 by FFT analysis.

As explained using FIGS. 6 and 7, if the fundamental tone (first harmonic) frequency of a musical tone of a certain pitch is f1, the second harmonic is about (f1×2) Hz, the third harmonic is about (f1×3) Hz, and the fourth harmonic is about (f1×4) Hz. At this time, the fundamental tone frequency of a musical tone one octave above this is about (f1×2) Hz, and the second harmonic is about (f1×4) Hz. The fundamental tone frequency of a musical tone two octaves above is (f1×4) Hz. Therefore, the second harmonic of a certain pitch and the fundamental tone frequency one octave above are substantially the same. Similarly, the fourth harmonic of a certain pitch, the second harmonic one octave above, and the fundamental tone frequency two octaves above are also substantially the same.

Even if there is no octave relationship, in some instances the frequencies of harmonics of different orders of different pitches are extremely close.

Separate resonance circuits do not need to be provided for such harmonics whose frequencies are substantially equal; it is acceptable to provide one resonance circuit whose resonance frequency is defined as the frequency of one harmonic or the average frequency of the harmonics. This enables the circuit scale of the resonance-tone generating means 3 described above to be reduced (the number of resonance circuits to be reduced).

FIG. 6 shows, in order from the top, harmonics of C_2, C_3, and C_4 by FFT analysis. The portions of the harmonics surrounded by rectangles in the figure can be produced with one resonance circuit. It is thus possible to omit the parts of the circuits corresponding to those portions.

FIG. 7 shows, in order from the top, harmonics of C_4, E_4, and A_4 by FFT analysis. The portions of the harmonics surrounded by a rectangle in the figure can be produced with one resonance circuit. It is thus possible to omit the parts of the circuits corresponding to those portions.

On the other hand, as shown in FIGS. 8 to 11, when the frequency of a harmonic included in the musical tone input to a resonance circuit and the resonance frequency of the resonance circuit to which it is input are extremely close, the resonance tone output from the resonance circuit is extremely large compared with a case where the frequency of a harmonic included in the musical tone input to a resonance circuit and the resonance frequency of the resonance circuit to which it is input differ (if a harmonic frequency of the musical tone and the resonance frequency of the resonance circuit are close, the amplitude of the resonance circuit output becomes excessively large). In such a case, rather than sound like the actual resonance tone to be obtained, it sounds like a steady musical tone having that resonance frequency.

Figure 8:
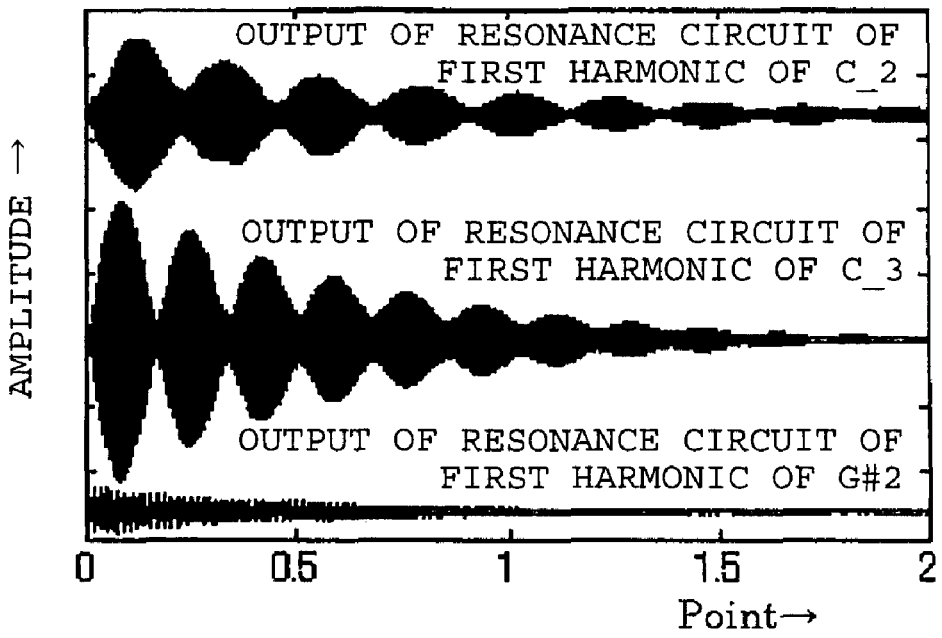
FIG. 8 is a graph showing resonance tones obtained when the musical note C_2 is input to resonance circuits for first harmonics of C_2, C_3, and G♯_2.
Figure 9:
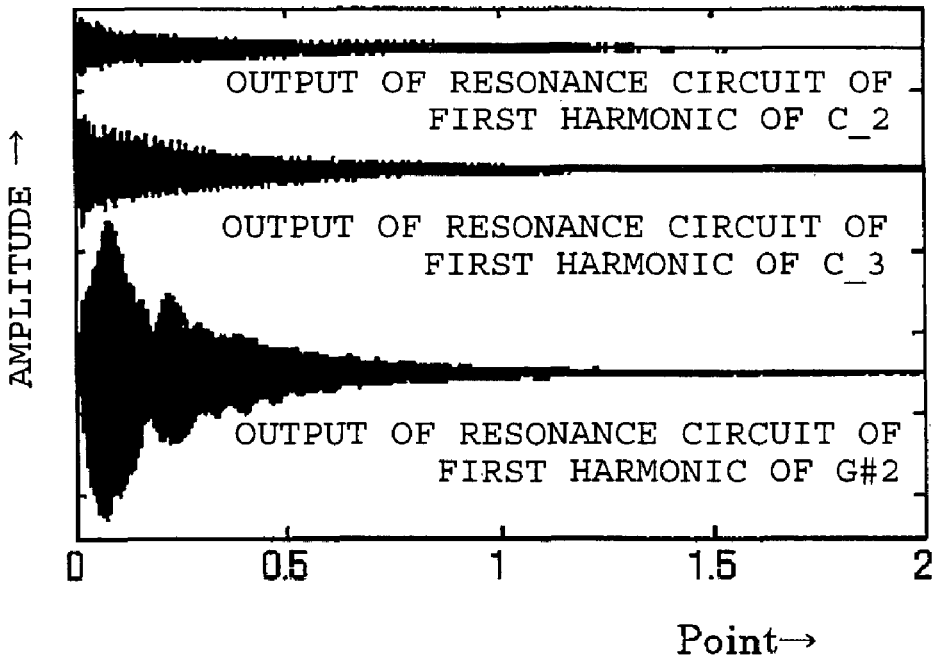
FIG. 9 is a graph showing resonance tones obtained when the musical note G♯_2 is input to resonance circuits for first harmonics of C_2, C_3, and G♯_2.

FIG. 8 shows, in order from the top, resonance tones obtained when a musical tone C_2 is input to a resonance circuit for the first harmonic of C_2, a resonance circuit for the first harmonic of C_3, and a resonance circuit for the first harmonic of G♯_2, respectively. FIG. 9 shows, in order from the top, resonance tones obtained when a musical tone G♯_2 is input to the resonance circuit for the first harmonic of C_2, the resonance circuit for the first harmonic of C_3, and the resonance circuit for the first harmonic of G♯_2.

In FIG. 8, the resonance tones of the resonance circuit for the first harmonic of C_2 and the resonance circuit for the first harmonic of C_3 are large. This is because the musical tone C_2 has harmonics of frequencies extremely close to the frequencies of the first harmonic of C_2 and the first harmonic of C_3. Similarly, in FIG. 9, the amplitude of the resonance tone of the resonance circuit for the first harmonic of G♯_2 is large. Thus, in the case shown in FIG. 8, the resonance tone sounds like the musical tone C_2. Similarly, in the case shown in FIG. 9, it sounds like the musical tone G♯_2. Thus, it does not sound as if the damper pedal is operated in the case of a piano.

With the present configuration, the resonance frequency of one resonance circuit corresponds to one harmonic frequency; however, the resonance-tone generating means 3 is configured to include resonance circuits corresponding to specific harmonic frequencies, which have the resonance frequencies shifted by a predetermined amount.

In other words, to make the amplitudes of the resonance tones in FIG. 8 and FIG. 9 substantially the same, the resonance frequencies of the resonance circuits should be shifted slightly.

The results obtained with the configuration described above are shown in FIGS. 10 and 11.

Figure 10:
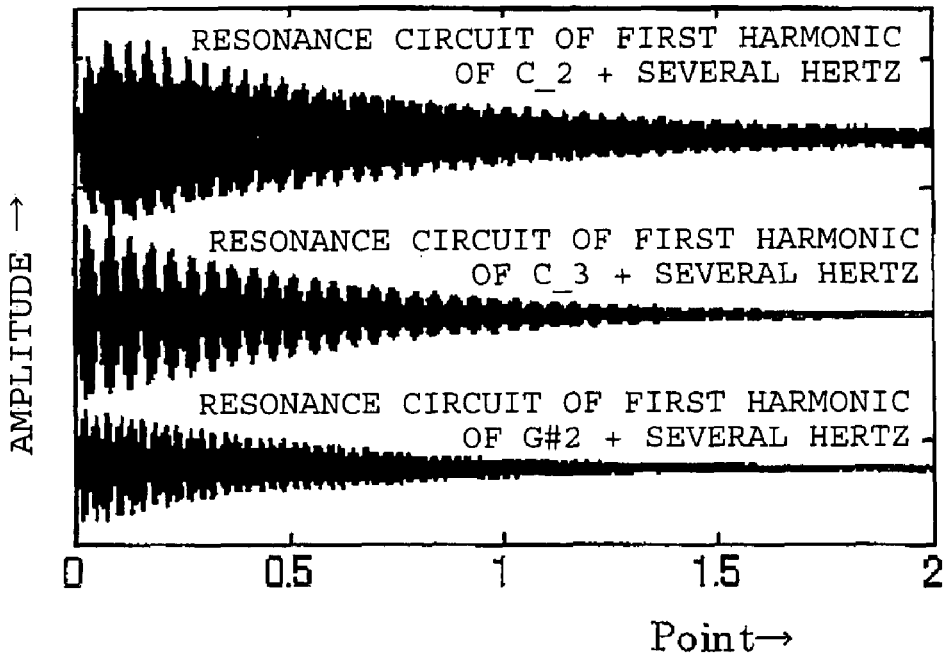
FIG. 10 is a graph showing resonance tones obtained when the musical note C_2 is input to respective resonance circuits whose resonance frequencies are shifted by several hertz from the first harmonics of C_2, C_3, and G♯_2.

FIG. 10 shows, in order from the top, resonance tones obtained when the musical tone C_2 is input to a resonance circuit whose resonance frequency is shifted by several hertz from the first harmonic of C_2, a resonance circuit whose resonance frequency is shifted by several hertz from the first harmonic of C_3, and a resonance circuit whose resonance frequency is shifted by several hertz from the first harmonic of G♯_2, respectively.

Figure 11:
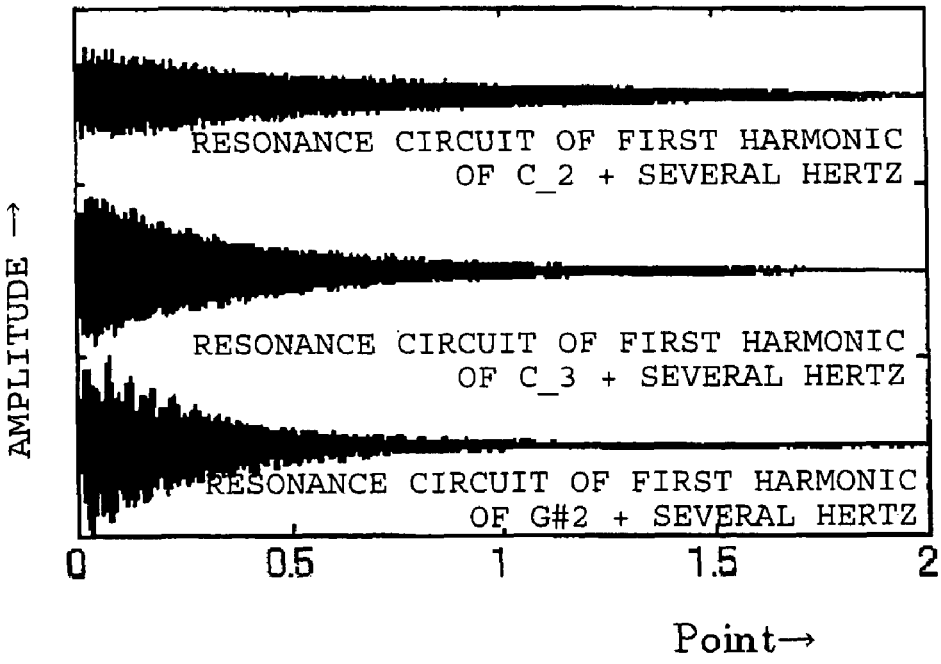
FIG. 11 is a graph showing resonance tones obtained when the musical note G♯_2 is input to respective resonance circuits whose resonance frequencies are shifted by several hertz from the first harmonics of C_2, C_3, and G♯_2.
Figure 12:
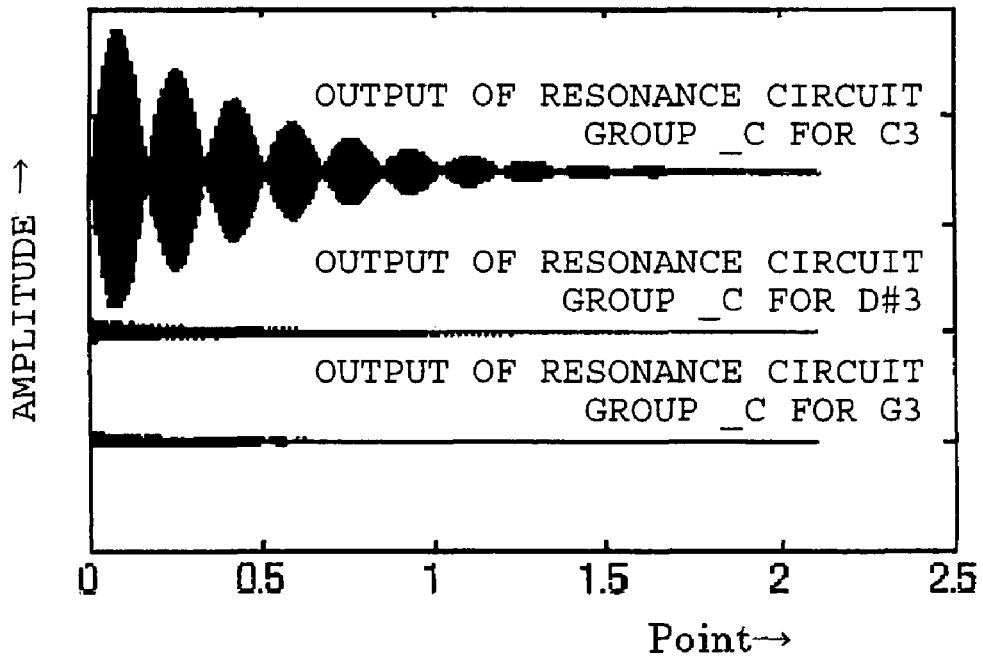
FIG. 12 is a diagram showing output waveforms, that is, resonance tones, obtained when waveforms of pitches C_3, D♯_3, and G_3 are input to a resonance circuit group _C.
Figure 13:
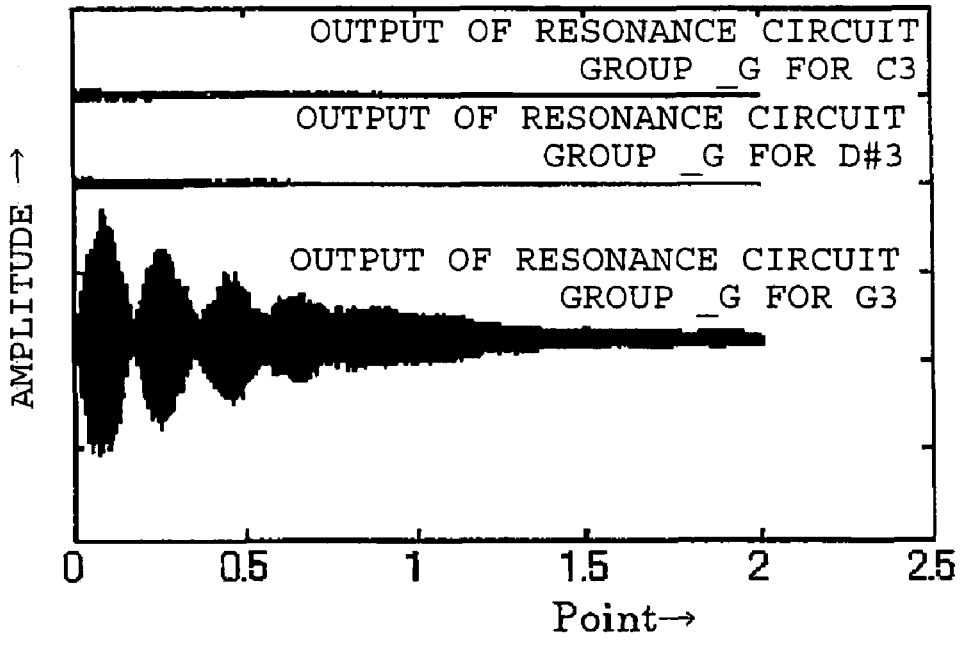
FIG. 13 is a diagram showing output waveforms, that is, resonance tones, obtained when waveforms of pitches C_3, D♯_3, and G_3 are input to a resonance circuit group _G.

FIG. 11 shows, in order from the top, resonance tones obtained when the musical tone G♯_2 is input to the resonance circuit whose resonance frequency is shifted by several hertz from the first harmonic of C_2, the resonance circuit whose resonance frequency is shifted by several hertz from the first harmonic of C_3, and the resonance circuit whose resonance frequency is shifted by several hertz from the first harmonic of G♯_2, respectively.

As is clear from these figures, by slightly shifting the resonance frequencies of the resonance circuits, it is possible to make the amplitudes of the resonance tones substantially the same.

Figure 24:
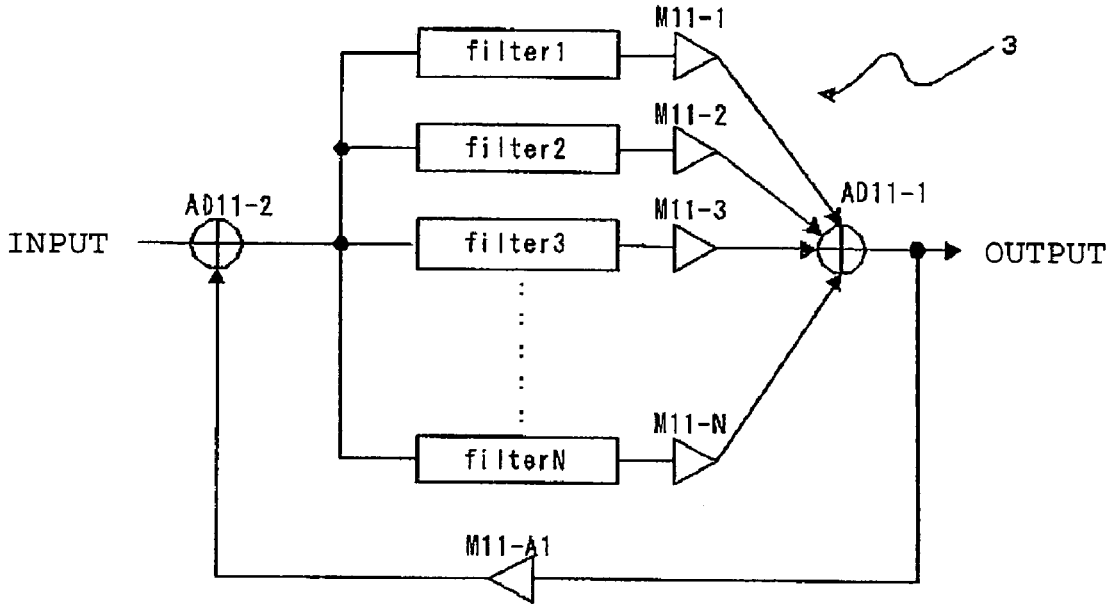
FIG. 24 is a diagram showing the configuration in a case where a feedback structure is added to the resonance-tone generating means.

In a piano, string vibrations are transmitted to a sounding board, which produces sound. At the same time, those vibrations are also transmitted to other strings via bridges. The vibrations transmitted to the other strings are then transmitted back to the original string via the bridges. Therefore, a piano has such a feedback circuit. In order to achieve this with a simple circuit configuration, a feedback path is provided in the resonance-tone generating means 3, as shown in FIG. 24. In other words, the resonance-tone generating means 3 may have a configuration in which the output thereof is multiplied by a predetermined factor with a multiplier M11-A1, is added to the original input musical tone with an adder AD11-2, and is input again to the resonance-tone generating means 3 as feedback.

Figure 25:
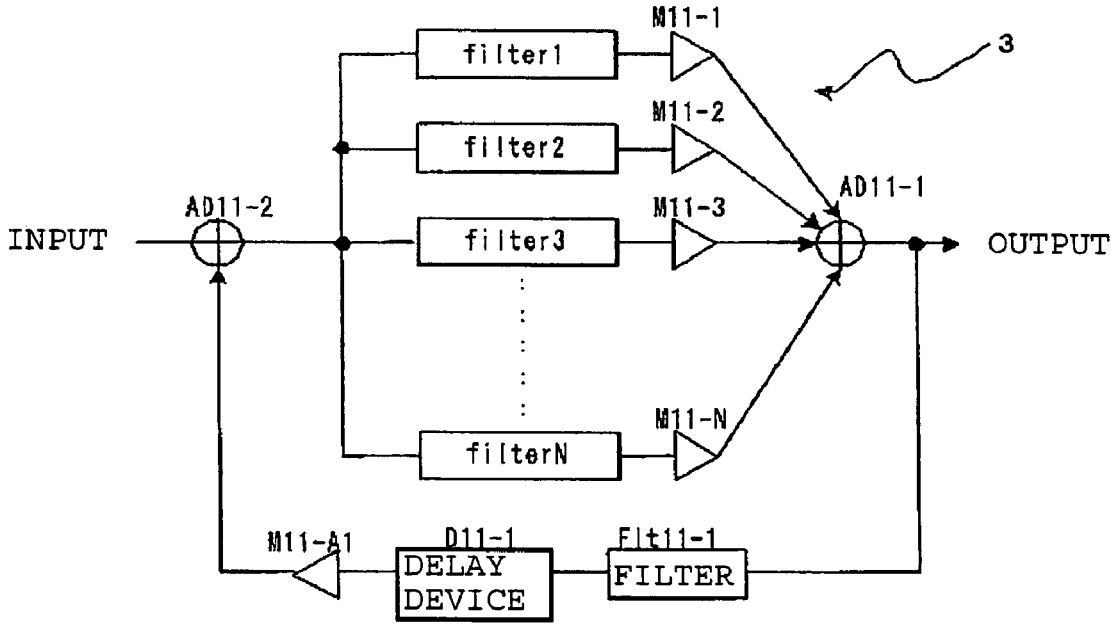
FIG. 25 is a diagram showing the configuration in a case where a feedback structure, a delay circuit, and a filter for changing an amplitude-frequency characteristic are added to the resonance-tone generating means.

In addition to the configuration in which the output of the resonance-tone generating means 3 is multiplied by the predetermined factor, is added to the input musical tone, and is input again to this resonance-tone generating means as feedback, as shown in FIG. 24, the resonance-tone generating means 3 may have, in the feedback path, a delay device D11-1 for delaying the output of the resonance-tone generating means 3 by a predetermined time and a filter Flt11-1 for changing the amplitude-frequency characteristic of the output of the resonance-tone generating means 3, as shown in FIG. 25. In this case, the delay device D11-1 simulates the propagation delay of the vibrations, and the filter Flt11-1 simulates the transfer characteristic of the bridges.

Second Embodiment

The configuration of a second embodiment is also related to an electronic piano. Since the hardware configuration and the functional block configuration thereof are substantially the same as those in FIGS. 18 and 19 of the first embodiment, a description of those figures and configurations will be omitted here.

In the configuration of the present embodiment, the configurations of musical-tone generating means 2 and resonance-tone generating means 3 are different from those in the first embodiment; therefore, the configuration of the functional blocks thereof will be described based on FIG. 26. It goes without saying that the musical-tone generating means 2 is formed of a sound source 206 and a DSP 207, as shown in this figure.

Figure 26:
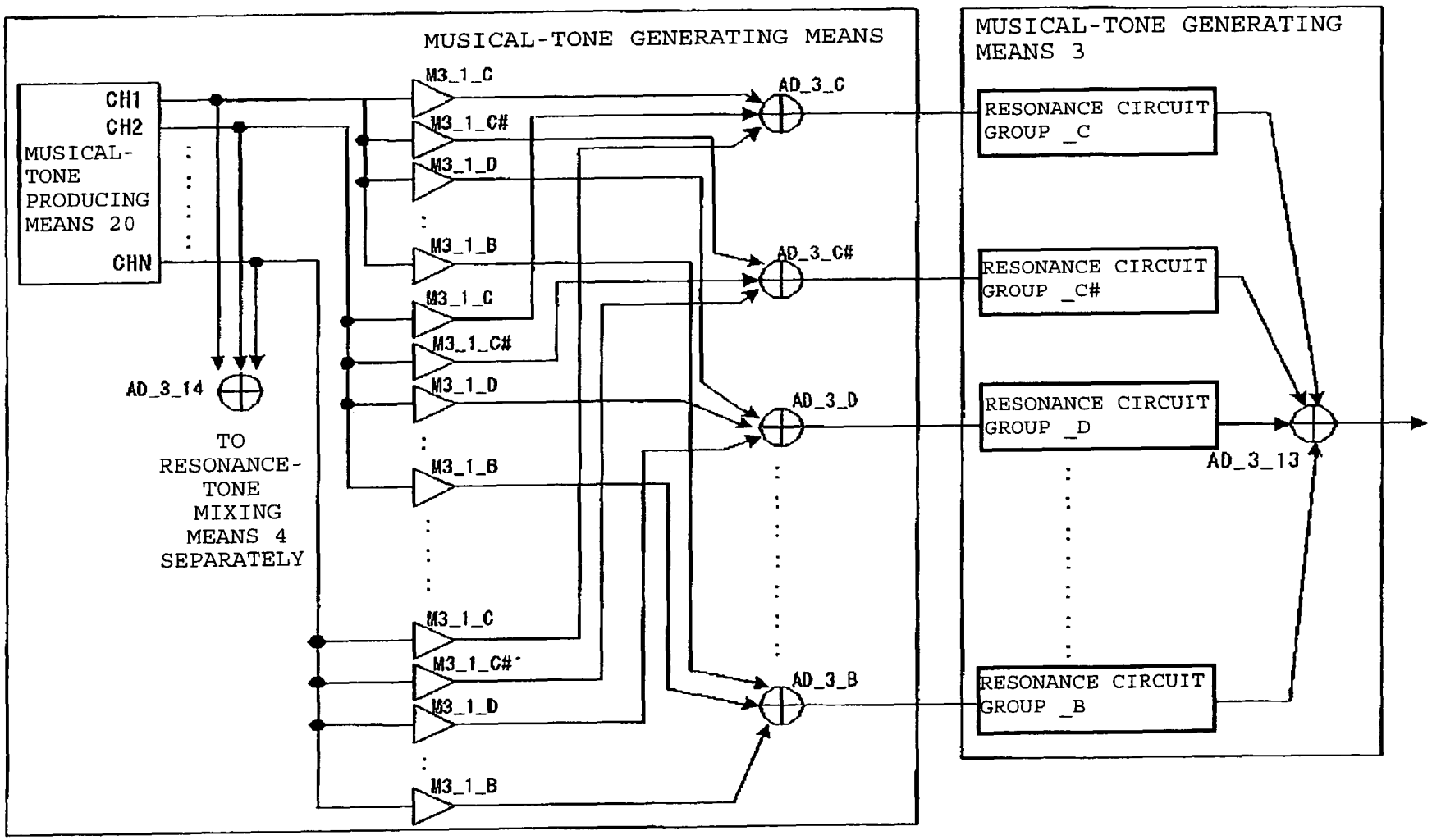
FIG. 26 is a diagram showing a functional block configuration of musical-tone generating means 2 and resonance-tone generating means 3 according to a second embodiment.

As shown in FIG. 26, the musical-tone generating means 2 in the configuration of this embodiment has musical-tone producing means 20 corresponding to a usual sound source. The musical-tone producing means 20 is provided, at the output side thereof, with musical-tone producing channels CH1 to CHN corresponding in number to tones to be generated.

Regarding the musical tones output therefrom, each musical-tone producing channel is split into two, and one of them is input to resonance-tone mixing means 4, as shown in FIG. 19.

For the other one, as shown in FIG. 26, a plurality of multipliers corresponding in number to the note names (since this embodiment is for an electronic piano, there are twelve: C (Do), C♯ (Do♯), D (Re), D♯ (Re♯), E (Mi), F (Fa), F♯ (Fa♯), G (So), G♯ (So♯), A (La), A♯(La♯), and B (Si)) are connected to each of the musical-tone producing channels CH1 to CHN. The outputs of the plurality of multipliers are further connected to adders (in this embodiment, twelve adders for C to B) for adding together outputs having identical note names in the channels (corresponding to respective note names in the same way). The output of each adder is sent to a corresponding resonance circuit group (in this embodiment, there are twelve from _C to _B), provided corresponding to each note name, in the resonance-tone generating means 3.

The reason for employing such a configuration is as follows.

If the resonance frequency of a resonance circuit and the frequency of a musical tone input thereto are closer, the amplitude of the output waveform (resonance tone) becomes larger. Therefore, there is no volume balance between the output waveform of a resonance circuit whose resonance frequency is far from the frequency of the input musical tone and the output waveform of a resonance circuit whose resonance frequency is extremely close to the frequency of the input musical tone. Thus, when a musical tone is input to a resonance circuit whose resonance frequency is extremely close to the frequency of the input musical tone, it is necessary to reduce the amplitude of the musical tone compared with when it is input to the other resonance circuits. In other words, the configuration of the multipliers and thereafter in each channel of the musical-tone generating means 2 is originally derived for the resonance-tone generating means 3 provided at the rear. When resonance tones are produced in the resonance circuit groups, this configuration reduces the amplitude of each input musical tone which otherwise causes no volume balance of the output waveform of each resonance circuit whose resonance frequency is extremely close to the frequency of the input musical tone, by using, from among the twelve multipliers _C to _B corresponding to the respective note names and connected to each of the musical-tone producing channels CH1 to CHN, a multiplier to which a musical tone whose frequency is extremely close to the resonance frequency of the resonance circuit corresponding to the multiplier is input, compared with when the musical tone is input to the other resonance circuits.

Here, the musical-tone producing means 20, the multipliers, and the adders in the musical-tone generating means 2 and the resonance circuit groups in the resonance-tone generating means 3 will be described separately based on FIG. 26.

As described above, the musical-tone generating means 2 has N musical-tone producing channels CH1 to CHN. The number of these musical-tone producing channels used corresponds to the number of musical tones to be generated. For example, when only the musical tone C_1 is generated, the musical tone C_1 is output only from CH1. When the musical tones C_1, E_1, and G_1 are generated, C_1 is output from CH1, E_1 from CH2, and G_1 from CH3.

Next, the multipliers mentioned above will be described. In the configuration of this embodiment, twelve multipliers corresponding to the note names form one group, and one group is provided for each musical-tone producing channel. Therefore, the total number of multipliers is N (the number of musical-tone producing channels)×12 (the total number of note names).

The output of one musical-tone producing channel is input to the twelve multipliers M3_x_C, M3_x_C♯, . . . , and M3_x_B corresponding to the note names (x indicates the number of each musical-tone producing channel and the letters at the end indicate the note names corresponding to the resonance circuit groups). The multipliers control the amplitudes of musical tones input to the resonance circuit groups _C to _B. The method of controlling the amplitude with each multiplier will be described later.

For example, when there is a musical tone from musical-tone producing channel 1, the musical tone from musical-tone producing channel 1 is input to all twelve multipliers M3_1_C to M3_1_B.

Twelve adders AD_3_C, AD_3_C♯, AD_3_D, . . . , and AD_3_B, corresponding to the note names, are provided in the configuration of this embodiment. The multipliers corresponding to the note names are connected to respective adders corresponding to the note names. This is because the outputs of the plurality of multipliers corresponding to the same note name are added and output to the resonance circuit group provided corresponding to the same note name. In other words, the outputs of the musical-tone producing channels, which are amplitude-controlled (via multipliers), are added for the resonance circuit groups. For example, the multipliers M3_1_C, M3_2_C, . . . , and M3_N_C are connected to the adder AD_3_C of the same note name (C), and the multipliers M3_1_C♯, M3_2_C♯, . . . , and M3_N_C♯ are connected to the adder AD_3_C♯ of the same note name (C♯).

The resonance circuit groups (_C, _C♯, . . . , _B) are provided corresponding to the note names [in this embodiment, the twelve note names C (Do), C♯(Do♯), D (Re), D♯ (Re♯), E (Mi), F (Fa), F♯ (Fa♯), G (So), G♯ (So♯), A (La), A♯ (La♯), and B (Si)].

One resonance circuit group is formed of resonance circuits corresponding to all harmonics of the note name of the resonance circuit group. For example, the resonance circuit group _C may be formed of resonance circuits corresponding to all harmonics of musical tone C_1, all harmonics of C_2, all harmonics of C_3, . . . , and all harmonics of C_8. Alternatively, it may be formed of resonance circuits corresponding to all harmonics of C_1, all harmonics of C_2, all harmonics of C_3, . . . , and all harmonics of C_6, which are in the range of tones for which the dampers are provided.

Figure 27:
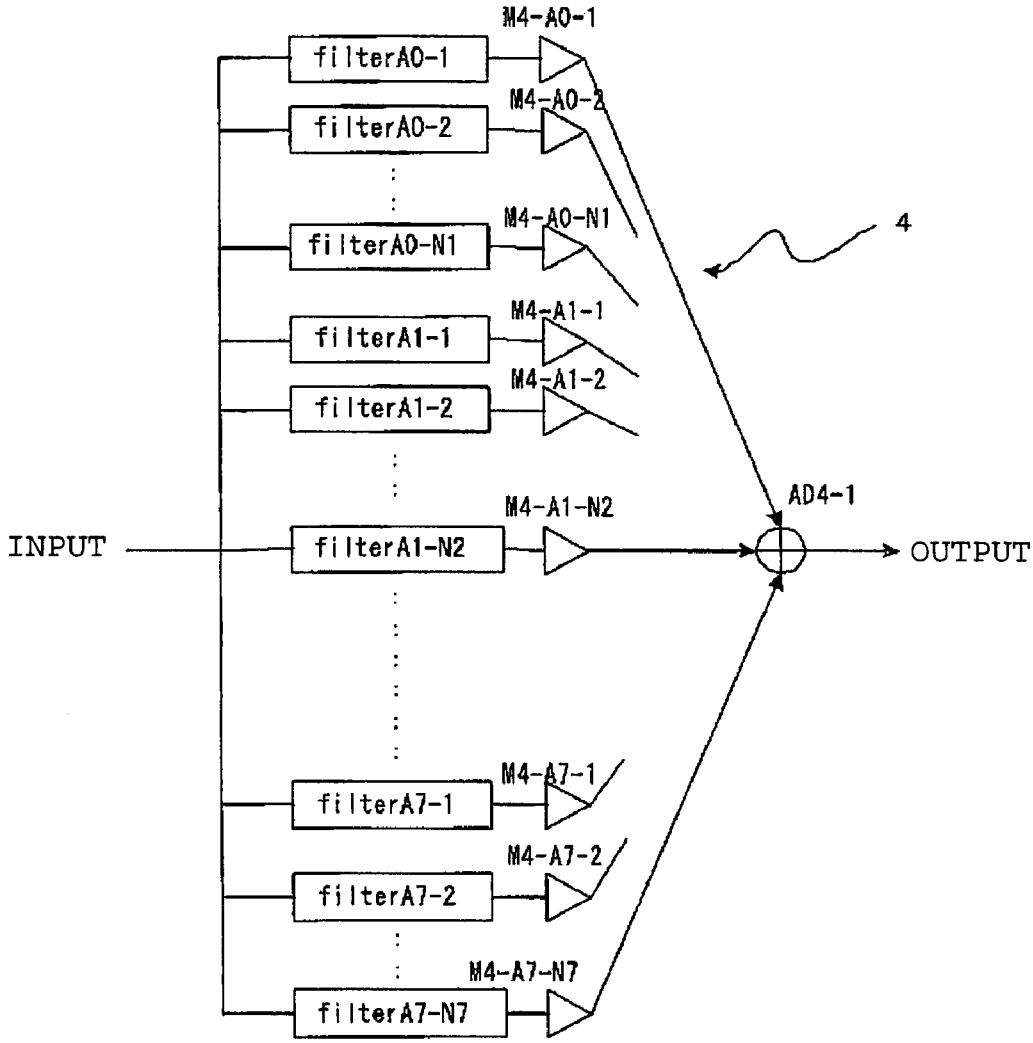
FIG. 27 is a diagram showing the configuration of a resonance circuit group corresponding to note name A, which is provided in the resonance-tone generating means 3 in the second embodiment.

In other words, as shown in FIG. 27, one filter and the multiplier connected thereto, as one set, form a resonance circuit having a resonance frequency corresponding to the frequency of one harmonic of one pitch (key). In this embodiment, a filter filterA0-1 and a multiplier M4-A0-1 form a resonance circuit having a resonance frequency corresponding to the frequency of the first harmonic of pitch A_0; similarly, a filter filterA0-2 and a multiplier M4-A0-2 correspond to the second harmonic of the pitch A_0, and a filter filterA0-

N1 and a multiplier M4-A0-N1 form a resonance circuit having a resonance frequency corresponding to the highest-order harmonic of the pitch A_0. Similarly, a filter filterA1-1 and a multiplier M4-A1-1, a filter filterA1-2 and a multiplier M4-A1-2, and a filter filterA1-N2 and a multiplier M4-A1-N2 form resonance circuits having resonance frequencies corresponding to the first harmonic, the second harmonic, and the highest-order harmonic of the pitch A_1, respectively.

The same thing applies to filters filterA7 . . . . This embodiment is illustrated by an example in which the resonance circuits corresponding to all harmonics at the eight pitches A_0, A_1, A_2, . . . , and A_7 are connected in parallel. Thus, there are multipliers M4-A0-1 to M4-A7-N7 in the resonance circuits. It is possible to desirably set the tonal quality of the resonance tone by setting the multiplication factors thereof to a desired value. Alternatively, the resonance circuits corresponding to all harmonics at the six pitches A_0, A_1, A_2, . . . , and A_5, which are in the range of tones for which the dampers are provided, may be connected in parallel.

There is also provided an adder AD4-1 for adding the outputs of all resonance circuits. Thus, the outputs from resonance circuits corresponding to one musical tone are combined into a single one.

Figure 28:
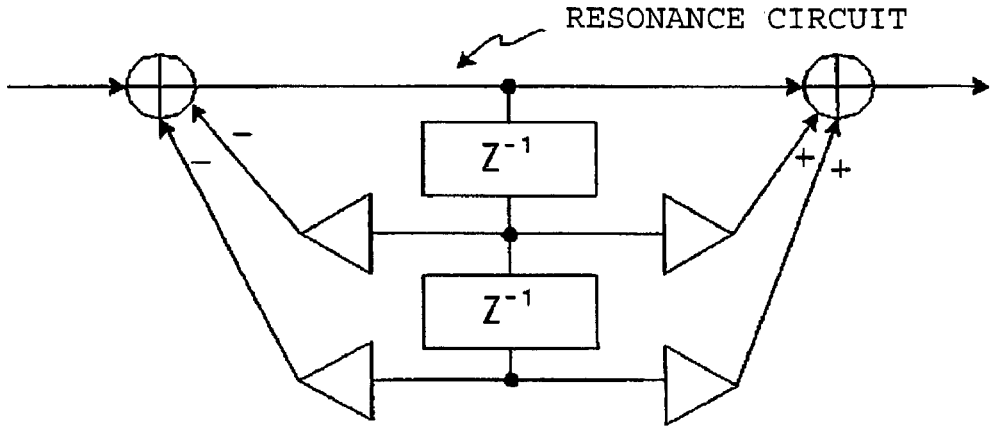
FIG. 28 is a diagram showing the configuration of a resonance circuit implemented by a second-order IIR filter.

Each resonance circuit is implemented by the DSP 207, as described above. As shown in FIG. 28, one resonance circuit is implemented as a second-order IIR filter (this is clear from the transfer function). In the figure, $Z^{(-1)}$ indicates a unit delay.

Next, the flow of signals in the configuration described above will be separately described in a case where only a single tone is produced from the musical-tone producing channels and a case where a plurality of tones are produced.

First, the case in which only a single tone is produced from the musical-tone producing channels will be described. It is assumed here that only the key C_1 is pressed. The musical tone C_1 is output from the musical-tone producing channel CH1 of the musical-tone producing means 20. The musical tone C_1 is output to an adder AD_3_C corresponding to the note name C via a multiplier M3_1_C corresponding to the note name C.

The musical tone C_1 is also output to an adder AD_3_C♯ corresponding to the note name C♯ via a multiplier M3_1_C♯ corresponding to the note name C♯.

Similarly, the musical tone C_1 is also input, via multipliers M3_1_D to M3_1_B corresponding to the other ten note names D to B, to adders AD_3_D to AD_3_B corresponding to the ten note names D to B.

Because the input musical tone at this time is C_1, only the multiplication factor of the multiplier M3_1_C is set to be smaller than in the other multipliers M3_1_D to M3_1_B. The same multiplication factor is set in the other multipliers M3_1_D to M3_1_B (for example, the multiplication factors of the other multipliers are set to 1, and only the multiplication factor of the multiplier M3_1_C is set to 0.1). Therefore, the amplitude of only the musical tone passing through the multiplier M3_1_C is reduced.

Each adder outputs the input musical tone C_1, after amplitude control, to the resonance circuit group corresponding to the same note name as the adder. In other words, adders AD_3_C to AD_3_B output the musical tone C_1 to the respective resonance circuit groups _C to _D.

Next, the case in which a plurality of tones are produced from the musical-tone producing channels will be described. First, it is assumed here that the keys C_1 and E_1 are pressed. The musical tone C_1 is output from CH1 of the musical-tone producing means, and the musical tone E_1 is output from CH2.

The musical tone C_1 is output to the adder AD_3_C corresponding to the note name C via the multiplier M3_1_C corresponding to the note name C. The musical tone C_1 is also output to the adder AD_3_C♯ corresponding to the note name C♯ via the multiplier M3_1_C♯ corresponding to the note name C♯. Similarly, the musical tone C_1 is input, via the multipliers M3_1_D to M3_1_B corresponding to the ten other note names D to B, to the adders AD_3_D to AD_3_B corresponding to the ten note names D to B.

Because the input musical tone at this time is C_1, only the multiplication factor of the multiplier M3_1_C is set smaller than that for the other multipliers M3_1_D to M3_1_B. The other multipliers M3_1_D to M3_1_B are set to the same factor. Therefore, only the amplitude of the musical tone passing through the multiplier M3_1_C is reduced.

Similarly, the musical tone E_1 is output to the adder AD_3_C corresponding to the note name C via the multiplier M3_2_C corresponding to the note name C. The musical tone E_1 is also output to the adder AD_3_C♯ corresponding to the note name C♯ via the multiplier M3_2_C♯ corresponding to the note name C♯. Similarly, the musical tone E_1 is input, via the multipliers M3_1_D to M3_1_B corresponding to the other ten note names D to B, to the adders AD_3_D to AD_3_B corresponding to the ten note names D to B.

Because the input musical tone at this time is E_1, only the multiplication factor of the multiplier M3_2_E is set smaller than that for the other multipliers M3_2_C to M3_2_D♯ and M3_2_F to M3_2_B. The other multipliers M3_2_C to M3_2_D♯ and M3_2_F to M3_2_B are set to the same factor. Therefore, the amplitude of only the musical tone passing through the multiplier M3_2_E is reduced.

The adders AD_3_C to AD_3_B add the amplitude-controlled musical tone C_1 (via the multipliers) and the amplitude-controlled musical tone E_1 and output them to the corresponding resonance circuit groups _C to _B, respectively.

Figure 14:
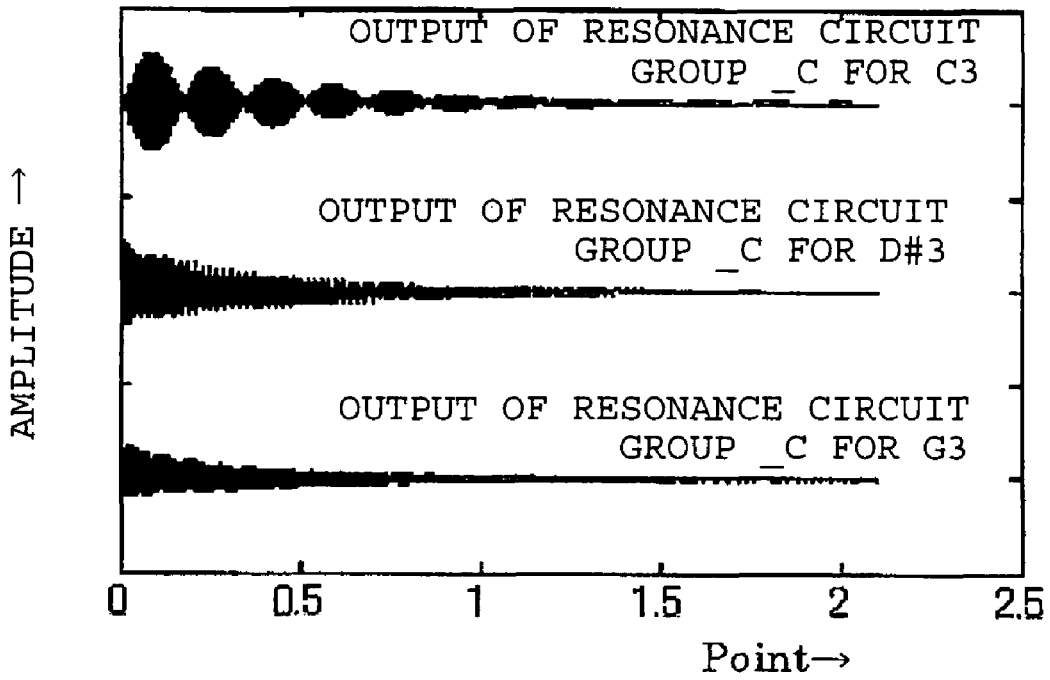
FIG. 14 is a diagram showing resonance tones obtained when waveforms of pitches C_3, D♯_3, and G_3 are input to the resonance circuit group _C with the amplitude of only the C_3 waveform being reduced.
Figure 15:
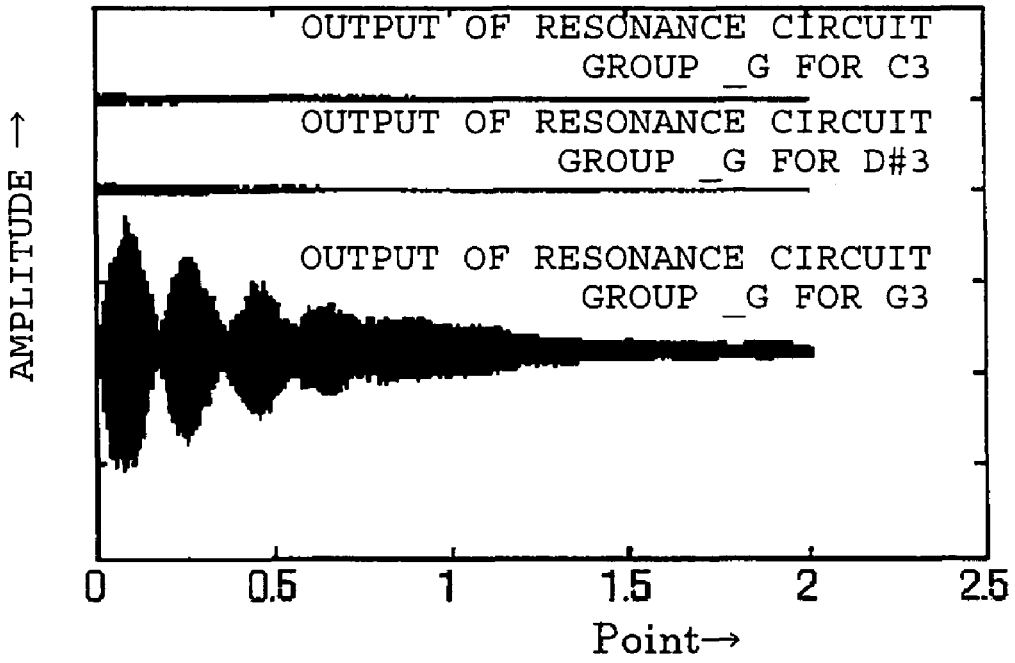
FIG. 15 is a diagram showing resonance tones obtained when waveforms of pitches C_3, D♯_3, and G_3 are input to the resonance circuit group G with the amplitude of only the G_3 waveform being reduced.
Figure 16:
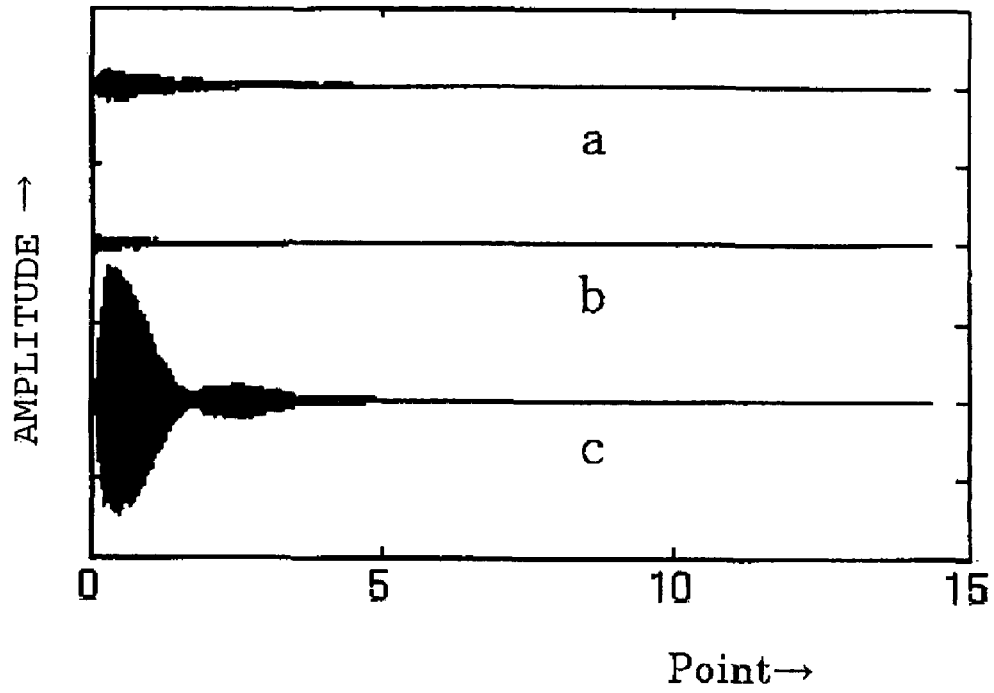
FIG. 16 is a graph showing the total outputs obtained when the musical note F_6 is input to a plurality of resonance circuits having the resonance frequencies of harmonics included in C_6, to a plurality of resonance circuits having the resonance frequencies of harmonics included in D♯_6, and to a plurality of resonance circuits having the resonance frequencies of harmonics included in F_6.
Figure 17:
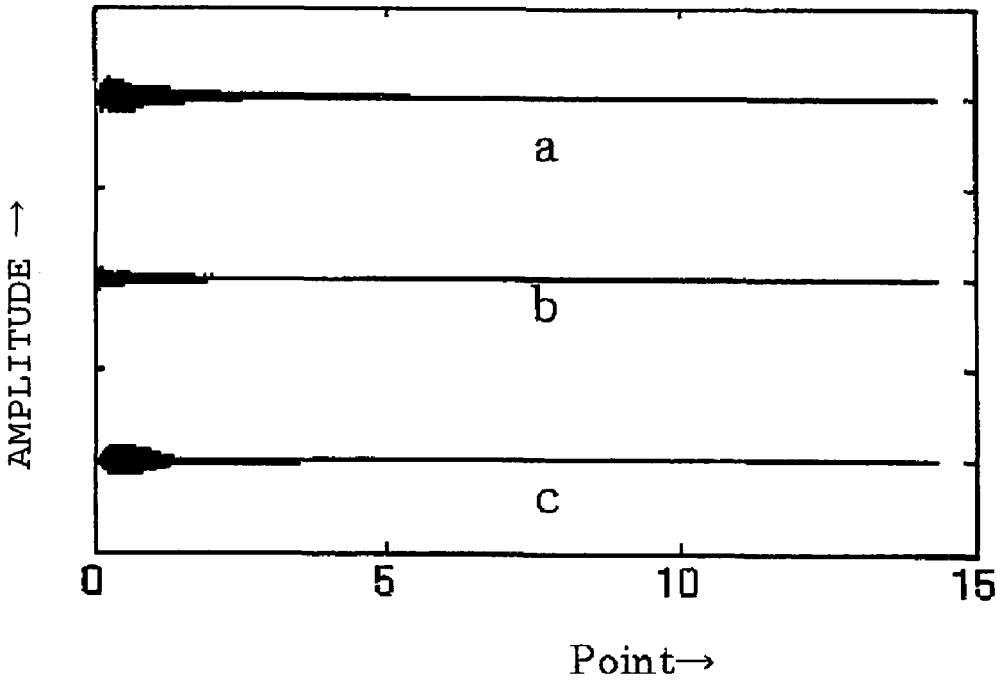
FIG. 17 is a graph showing the total outputs obtained when the output levels of the C_6 resonance circuits and the D♯_6 resonance circuits are set to 1, and the output levels of the F_6 resonance circuits are set to 0.1.

When the frequency of a harmonic included in the musical tone input to a resonance circuit and the resonance frequency of the resonance circuit to which it is input are extremely close, compared with a case where these frequencies are different, in some instances the resonance tone output from the resonance circuit becomes extremely large. Therefore, there is no volume balance between the output waveform of a resonance circuit whose resonance frequency is far from the frequency of the input musical tone and the output waveform of a resonance circuit whose resonance frequency is extremely close to the frequency of the input musical tone, and it is thus impossible to obtain sound like the actual resonance tone to be desired. However, as in the configuration of this embodiment, when a musical tone is input to a resonance circuit whose resonance frequency is extremely close to the frequency of the musical tone, the amplitude of the musical tone is made smaller compared with when it is input to the other resonance circuits. Therefore, according to the example described above, when the musical tones are input to the resonance circuit group _C, the amplitude of only the waveform of C_3 is reduced, and therefore, the resonance tones thereof, as well as the resonance tone of any pitch, have substantially the same amplitude, as shown in FIG. 14. Similarly, when the musical tones are input to the resonance circuit group _G, the amplitude of only the waveform of G_3 is reduced, and therefore, as shown in FIG. 15, the resonance tone of any pitch also has substantially the same amplitude. Thus, because the configuration of this embodiment is for an electronic piano, it is possible to obtain sound like that obtained when the damper pedal is actually operated.

Figure 29:
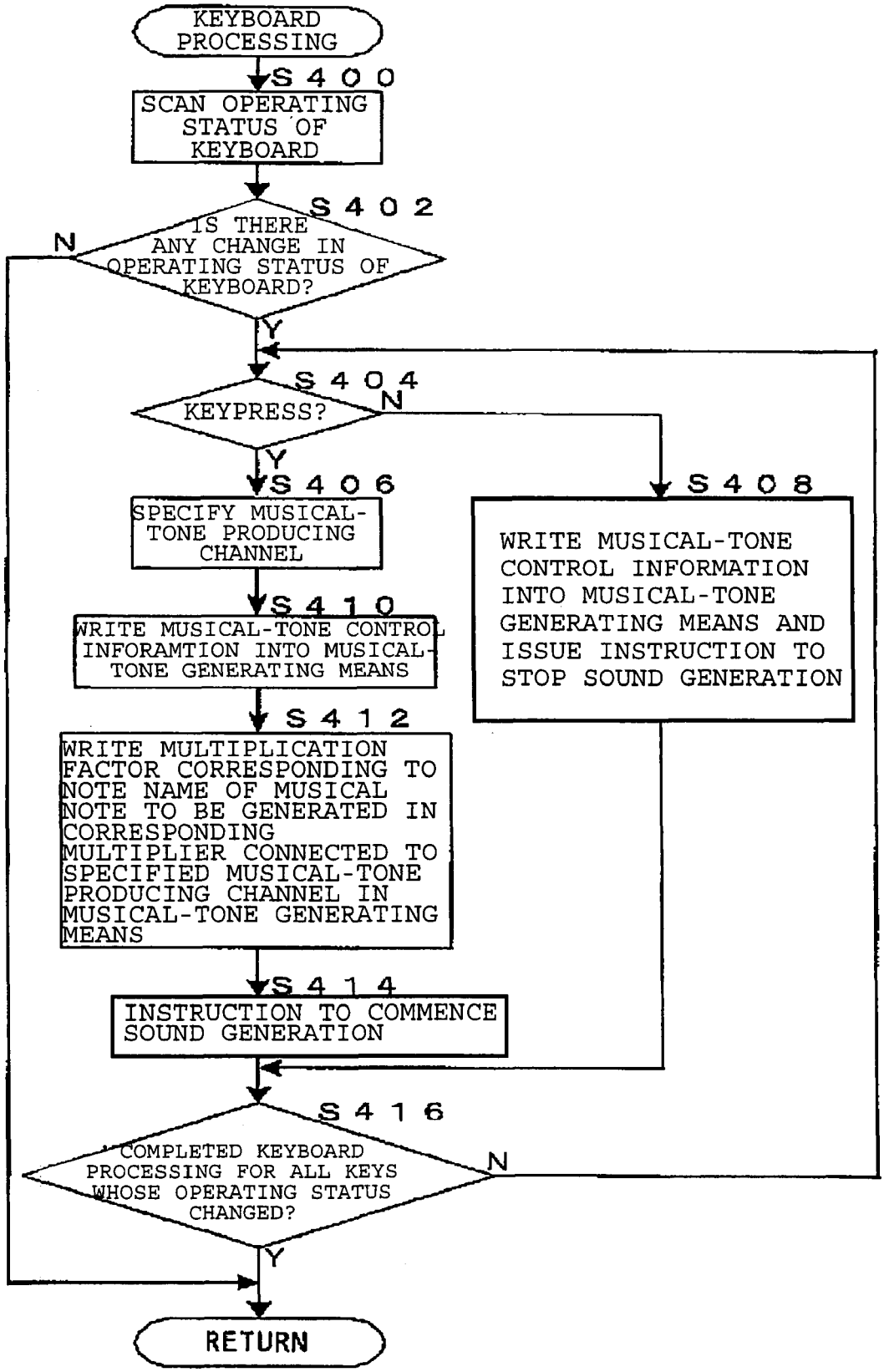
FIG. 29 is a flowchart showing a keyboard processing flow in the second embodiment.

Here, processing flows of the operation of the electronic piano of this embodiment will be described. A main processing flow is basically the same as that in FIG. 21, and a pedal processing flow is basically the same as that in FIG. 23; descriptions thereof are thus omitted. FIG. 29 shows a keyboard processing flow in the electronic piano of this second embodiment.

As shown in FIG. 29, the operating status of the keyboard 204 is scanned (step S400). Then, it is checked whether or not there is a change in the operating status of the keyboard 204 (step S402).

If there is no change in the operating status of the keyboard 204 (No in step S402), the keyboard processing ends, and the processing proceeds to the pedal processing in the main flow. On the other hand, if there is a change in the operating status of the keyboard 204 (Yes in step S402), it is checked whether or not the operation corresponding to that change is a keypress (step S404).

If it is not a keypress (No in step S404), musical-tone control information is written in the musical-tone generating means 2, a sound-generation stop instruction is output (step S408), and the processing proceeds to the step S416. On the other hand, if it is a keypress (Yes in step S404), a musical-tone producing channel is specified (step S406). Then, the musical-tone control information is written in the musical-tone generating means 2 (step S410).

Next, a multiplication factor corresponding to the name of the note to be generated is written in the corresponding multiplier connected to the specified musical-tone producing channel of the musical-tone generating means 2 (step S412). Thereafter, a sound-generation start instruction is output (step S414).

Finally, it is checked whether or not the processing for all keys whose operating status has changed has been completed (step S416).

If the processing for all keys whose operating status has changed has not been completed (No in step S416), the processing returns to step S404. On the other hand, if the processing for all keys whose operating status has changed has been completed (Yes in step S416), the keyboard processing ends, and the processing proceeds to the pedal processing in the main flow.

Also in the configuration of this embodiment, the musical-tone generating means 1 generates musical tones, and a resonance tone is obtained by inputting the musical-tone signals to the resonance-tone generating means 3, which is formed of a plurality of series of resonance circuit groups _C to _B (twelve series in a general musical instrument such as the piano described above) corresponding to the note names of the musical tones (C, C♯, D, . . . , and B in a general musical instrument such as the piano).

At this time, in the configuration of this embodiment, with the structure described above, a generated musical-tone signal is input to a resonance circuit group of the same note name (when input to a resonance circuit whose resonance frequency is extremely close to the frequency of the generated musical-tone signal) with a small amplitude (according to the example described above, when the amplitude of only the waveform of C_3 is reduced if the musical tones are input to the resonance circuit group _C, the amplitude of the resonance tone of any pitch is substantially the same, as shown in FIG. 14; similarly, when the amplitude of only the waveform of G_3 is reduced if the musical tones are input to the resonance circuit group _G, the resonance tone of any pitch also has substantially the same amplitude, as shown in FIG. 15), and the generated musical-tone signal is input to resonance circuits of different note names with a large amplitude. Therefore, the output of the resonance circuit group having the same note name as the input musical tone is prevented from becoming significantly larger than the outputs of the other resonance circuit groups, thus allowing a resonance tone with good balance to be obtained. Accordingly, in the case of a piano, it is possible to obtain sound like that obtained when the damper pedal is actually operated.

Also in the configuration of this embodiment, as described using FIGS. 6 and 7, without having separate resonance circuits for harmonics whose frequencies are substantially the same, it is sufficient to provide one resonance circuit whose resonance frequency is equal to the frequency of one of the harmonics or the average frequency of the frequencies of the harmonics. Therefore, the circuit scale of the resonance-tone generating means 3 can be reduced (the number of resonance circuits can be reduced).

Also in the configuration of this embodiment, as described using FIG. 24, the resonance-tone generating means 3 may be configured such that the output of the resonance-tone generating means 3 is multiplied by a predetermined factor, is added to the input musical tone, and is input again to this resonance-tone generating means as feedback. In addition to the configuration shown in FIG. 24, a delay device D11-1 for delaying the output of the resonance-tone generating means 3 by a predetermined time and a filter Flt11-1 for changing the amplitude-frequency characteristic of the output of the resonance-tone generating means 3 may be provided in the feedback path, as described using FIG. 25.

Third Embodiment

The configuration of a third embodiment is also related to an electronic piano. Since the hardware configuration thereof is substantially the same as that in FIG. 18 of the first embodiment, a description of the figure and configuration is omitted here.

Figure 30:
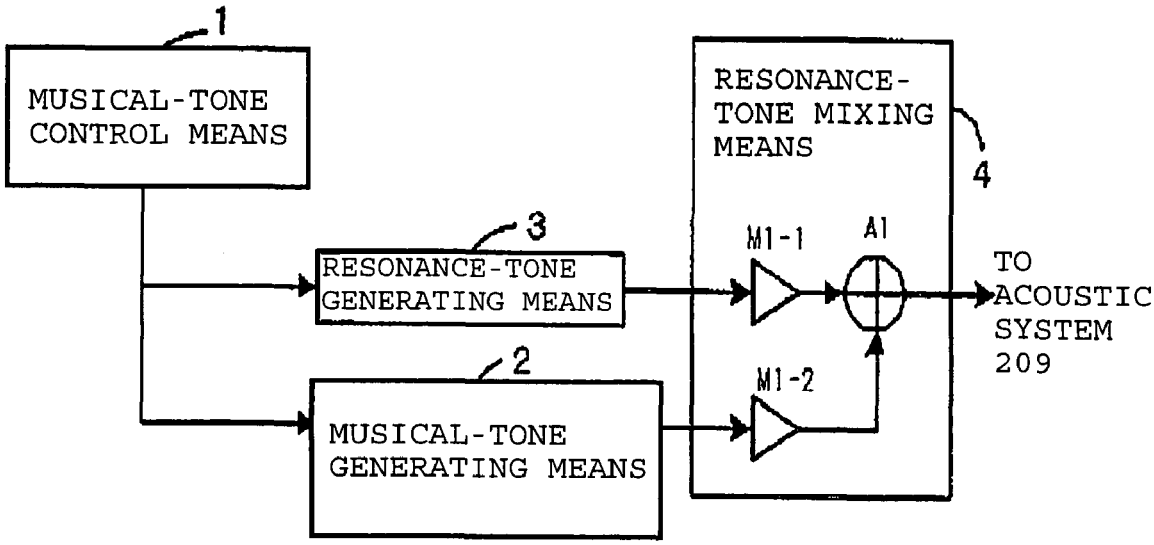
FIG. 30 is a functional block diagram showing the configuration of a third embodiment applied to an electronic piano.

The configuration of this embodiment differs from those of the preceding two embodiments in that, as shown in FIG. 30, musical-tone control information output from musical-tone control means 1 is input to both musical-tone generating means 2 and resonance-tone generating means 3; a musical tone and a resonance tone are separately generated therefrom; the musical tone and the resonance tone are added in an adder A1 via respective multipliers M1-1 and M1-2; and the resultant is output to an acoustic system 209. Therefore, a description will be given based on the functional block diagram shown in FIG. 30. Resonance-tone mixing means 4 shown in this figure is formed of a DSP 207, and one example configuration is shown in a portion surrounded by a dotted line in FIG. 30. The resonance-tone generating means 3 is configured to read out waveforms from a waveform memory storing resonance-tone waveforms created by resonance-tone calculating means 5 provided separately from this electronic piano, which will be described later.

Because the configurations of the musical-tone control means 1 and the musical-tone generating means 2 shown in FIG. 30 are the same as the configurations in the first and second embodiments, a description thereof is omitted here.

Similarly to the musical-tone generating means 2, the resonance-tone generating means 3 in this embodiment is formed of a readout-type sound source and a waveform memory storing resonance-tone waveforms, although they are not shown in the figure. In the configuration of this embodiment, the musical-tone generating means 2 and the resonance-tone generating means 3 are formed of the same sound source and waveform memory, but they may use separate sound sources and waveform memories.

In the figure, a multiplier M1-1 multiplies the amplitude of the resonance tone sent from the resonance-tone generating means 3 by a predetermined factor. The multiplication factor thereof is determined according to the degree-of-depression of a damper pedal 205 in the musical-tone control information output from the musical-tone control means 1. A multiplier M1-2 multiplies the amplitude of the musical tone sent from the musical-tone generating means 2 by a predetermined degree. An adder A1 adds the resonance tone and the musical tone which have been subjected to the multiplications.

As described above, the resonance-tone generating means 3 is formed of the readout-type sound source and the waveform memory which stores resonance-tone waveforms; therefore, the electronic piano does not create a resonance tone. Resonance tone waveforms are created in advance by the resonance-tone calculating means 5, provided separately from this electronic piano, and are stored in the waveform memory, serving as resonance-tone waveform storing means.

Figure 31:
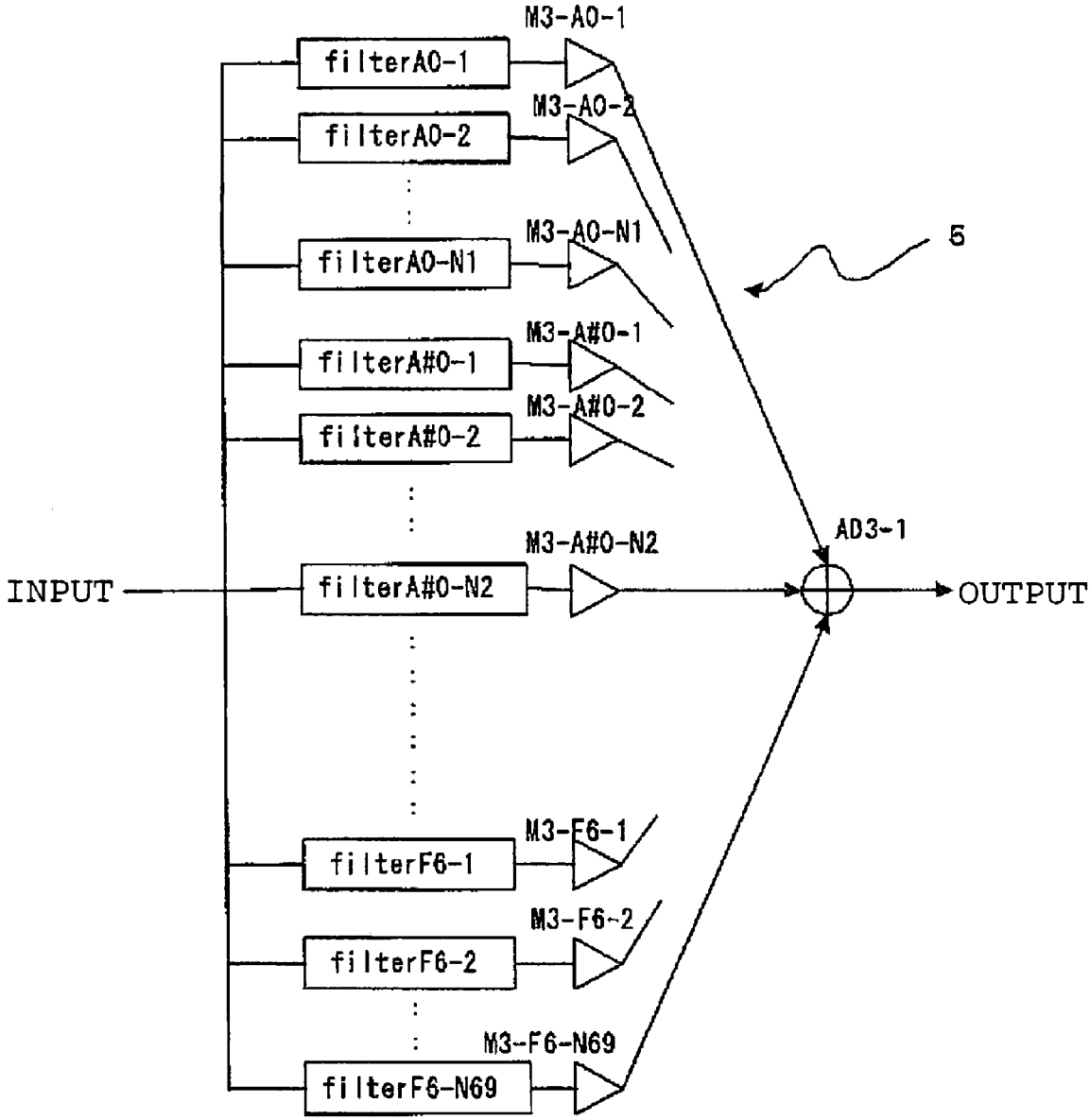
FIG. 31 is a functional block diagram showing resonance-tone calculating means 5 used when creating resonance-tone waveforms to be stored in resonance-tone-waveform storing means in the electronic piano.

FIG. 31 shows an example of the resonance-tone calculating means 5, used as a separate configuration from the electronic piano in this embodiment. The resonance-tone calculating means 5 is implemented by a signal processing unit and a program describing the signal processing procedure of the signal processing unit.

As shown in this figure, one filter and the multiplier connected thereto form one set and constitute a resonance circuit having a resonance frequency corresponding to the frequency of one harmonic of one pitch (key). In this embodiment, a filter filterA0-1 and a multiplier M3-A0-1 form a resonance circuit having a resonance frequency corresponding to the frequency of the first harmonic of the pitch A_0; similarly, a filter filterA0-2 and a multiplier M3-A0-2 correspond to the second harmonic of the pitch A_0, and a filter filterA0-N and a multiplier M3-A0-N form a resonance circuit having a resonance frequency corresponding to the frequency of the highest-order harmonic of the pitch A_0. Similarly, a filter filterA♯0-1 and a multiplier M3-A♯0-1, a filter filterA♯0-2 and a multiplier M3-A♯0-2, and a filter filterA♯0-N2 and a multiplier M3-A♯0-N2 form resonance circuits having resonance frequencies corresponding to the frequencies of the first harmonic, the second harmonic, and the highest-order harmonic of the pitch A♯_0, respectively. An adder AD3-1 adds the outputs of all of the resonance circuits.

The same thing applies to the filters filterF6 . . . . This embodiment is an example in which the resonance circuits corresponding to all harmonics at all pitches A_0 to F_6 are connected in parallel. The reason why the filters in this embodiment end with A0 to F6 is that, in a piano, the pitches that are damped by the damper pedal 205 correspond to the 69 keys from A_0 to F_6. If necessary, a filter for each harmonic of F♯_6 to C_8 may be provided. When the present invention is applied to other musical instruments, it is not necessary to stick to the range A_0 to F_6.

It is possible to desirably set the tonal quality of the resonance tone by setting the multiplication factors of multipliers M3-A0-1 to M3-F6-N69 for the resonance circuits to a desired value.

Because the resonance-tone waveforms calculated in the resonance-tone calculating means 5 configured in this way are stored in the resonance-tone waveform memory, the resonance-tone calculating means 5 is used in a production stage of the electronic piano, and is usually not included in the electronic piano; however, the resonance-tone calculating means 5 may be included in the electronic piano to create a new resonance tone and to store it in the resonance-tone waveform memory.

The resonance-tone calculating means 5 has been described above. A flow in playing the electronic piano according to this embodiment, in which the resonance tones created in this way are stored in the waveform memory, will be described in sequence.

First, when a key 204 is pressed, musical-tone control information, such as a pitch corresponding to that key and an intensity (velocity) corresponding to the keypress speed, is generated by the musical-tone control means 1 and is sent to the musical-tone generating means 2. When a plurality of keys are pressed, musical-tone control information, such as a plurality of pitches and intensities corresponding thereto, is sent to the musical-tone generating means 2 by the musical-tone control means 1.

The musical-tone generating means 2 reads out a musical tone corresponding to that musical-tone control information and sends it to the resonance-tone mixing means 4. When a plurality of musical tones are generated, those musical tones are added and sent to the resonance-tone mixing means 4. For example, when the C_3 and G_3 keys 204 are operated strongly, a musical-tone waveform corresponding to the strong striking of C_3 and a musical-tone waveform corresponding to the strong striking of G_3 are read out from the waveform memory, and the waveform formed by adding them together is sent to the resonance-tone mixing means 4 as a musical tone.

The musical-tone control information is also sent simultaneously to the resonance-tone generating means 3. The resonance-tone generating means 3 reads out a resonance-tone waveform corresponding to the pitch and operating intensity of the operated key from the waveform memory storing resonance-tone waveforms, adds them, and sends the resultant to the resonance-tone mixing means 4. For example, if the C_3 and G_3 keys are operated strongly, a resonance-tone waveform corresponding to strong striking of C_3 and a resonance-tone waveform corresponding to strong striking of G_3 are read out from the waveform memory, and the waveform formed by adding them is sent to the resonance-tone mixing means 4 as a musical tone.

In this case, even if the damper pedal 205 is not operated, the resonance-tone waveform is still read out.

For both the resonance-tone generation and musical-tone generation described above, the amplitudes may be changed at a readout time, without selecting a waveform in response to the operating intensity of the operated key. In addition, the envelopes may also be changed.

The resonance-tone mixing means 4 adds, in the adder A1, the resonance tone multiplied by the predetermined factor in the multiplier M1-1 and the musical tone multiplied by the predetermined degree in the multiplier M1-2 and outputs the sum to acoustic output means. The multiplication factor of M1-1 at this time depends on the musical-tone control information. The musical-tone control means 1 detects the degree-of-depression of the damper pedal 205 and changes the value of the multiplication factor of the multiplier M1-1 each time the damper pedal is operated. As the degree-of-depression increases, the multiplication factor increases, and as the degree-of-depression decreases, the multiplication factor decreases. (The resonance tone is read out regardless of the operation of the damper pedal 205. The only thing that changes with the operation of the damper pedal 205 is the multiplication factor of the multiplier M1-1 in the resonance-tone mixing means 4. In a state where the damper pedal 205 is not operated, because the multiplication factor of the multiplier M1-1 is 0, the amplitude of the resonance tone is 0, giving the impression that no resonance tone is generated.) It is also possible to use a multiplication factor of 0 from nil degree-of-depression up to a predetermined degree of depression and to use a certain fixed value once the predetermined degree-of-depression is exceeded.

Figure 32:
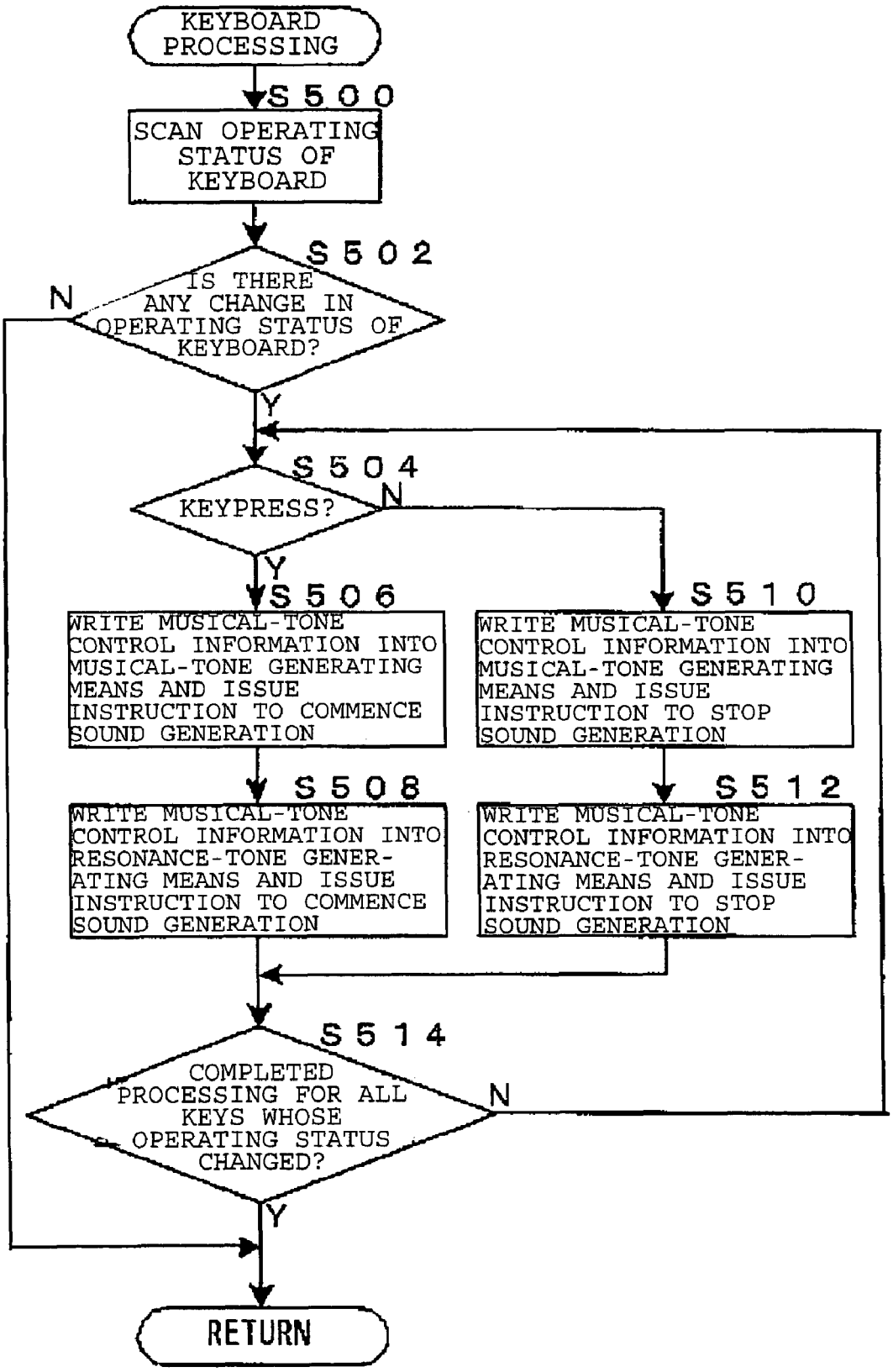
FIG. 32 is a flowchart showing a keyboard processing flow in the third embodiment.

Processing flows of the operation of the electronic piano in this embodiment will be described here. Since a main processing flow is basically the same as that in FIG. 21 and a pedal processing flow is basically the same as that in FIG. 23, descriptions thereof are omitted here. FIG. 32 shows a keyboard processing flow of the electronic piano of the third embodiment.

As shown in FIG. 32, the operating status of the keyboard 204 is scanned (step S500). Then, it is checked whether or not there is a change in the operating status of the keyboard 204 (step 502).

If there is no change in the operating status of the keyboard 204 (No in step S502), the keyboard processing ends, and the processing proceeds to the pedal processing in the main flow. On the other hand, if there is a change in the operating status of the keyboard 204 (Yes in step S502), it is checked whether or not the operation corresponding to that change is a keypress (step S504).

If it is a keypress (Yes in step S504), the musical-tone control information is written into the musical-tone generating means 2 and a sound-generation start instruction is output (step S506); and then, the musical-tone control information is written into the resonance-tone generating means 3 and a sound-generation start instruction is output (step S508). On the other hand, if it is not a keypress (No in step S504), the musical-tone control information is written into the musical-tone generating means 2 and a sound-generation stop instruction is output (step S510); and then, the musical-tone control information is written into the resonance-tone generating means 3 and a sound-generation stop instruction is output (step S512).

Finally, it is checked whether or not the processing for all keys whose operating status has changed has been completed (step S514).

If the processing for all keys whose operating status has changed has not been completed (No in step S514), the processing returns to step S504. On the other hand, if the processing for all keys whose operating status has changed has been completed (Yes in step S514), the key processing ends, and the processing proceeds to the pedal processing in the main flow.

In the configuration of this embodiment, the musical tone is generated by the musical-tone generating means 2 after it receives the musical-tone control information, and the resonance tone is generated by the resonance-tone generating means 3 after it simultaneously receives that musical-tone control information.

Regarding this resonance tone, a resonance-tone waveform corresponding to an expected musical tone to be played is generated in advance by the resonance-tone calculating means 5, and the resonance tone waveform is stored in the waveform memory. The waveform memory is prepared in a production stage as the resonance-tone-waveform storing means of this electronic piano. Therefore, as described above, the musical tone is generated by the musical-tone generating means 2 at the same time that the resonance tone is generated by the resonance-tone generating means 3 after it receives the musical-tone control information.

As described above, the resonance-tone calculating means 5 may be incorporated in the electronic piano. By doing so, it is possible to produce a new resonance tone in the electronic piano.

Also in the configuration of this embodiment, the resonance-tone generating means 3 may have a configuration in which the output of the resonance-tone generating means 3 is multiplied by a predetermined degree, is added to the input musical tone, and is input again to the resonance-tone generating means as feedback, as described using FIG. 24. In addition to the configuration in FIG. 24, a delay device D11-1 for subjecting the output of the resonance-tone generating means 3 to a predetermined delay and a filter Flt11-1 for changing the amplitude-frequency characteristic of the output of the resonance-tone generating means 3 may be provided in this feedback path, as shown in FIG. 25.

The electronic pianos have been described above as examples with reference to the drawings. The electronic musical instrument of the present invention is not limited only to an electronic piano. Other musical instruments taking a similar form that do not depart from the scope of the present invention are possible.

INDUSTRIAL APPLICABILITY

An electronic musical instrument according to the present invention can be applied to a configuration in which a resonance tone like that obtained when a musical instrument is played can be generated at the same time that a musical tone is generated. In addition to an electronic musical instrument, the present invention can also be applied to a case where sound is generated or air vibrations are caused to obtain resonance sound thereof in a sound effect studio for obtaining a specific sound effect.

The invention claimed is:

1. An electronic musical instrument comprising, at least for outputting a musical tone:

a musical-tone control unit comprising a plurality of operators, which generates operating information of the plurality of operators as musical-tone control information for specifying at least a sound-generation start, a sound-generation stop, a pitch, an operating intensity, and an operating amount;

a musical-tone generating unit which simultaneously generates a plurality of musical tones according to the musical-tone control information;

a resonance-tone generating unit comprising resonance circuits equal in number to harmonic signals of musical-tone signals that can be generated, which generates a resonance tone with the resonance circuits using a musical tone generated by the musical-tone generating unit as an input signal to each resonance circuit; and a resonance-tone mixing unit which multiplies the resonance tone generated by the resonance-tone generating unit, by a predetermined degree according to the musical-tone control information, which adds the product to the input musical tone from the musical-tone generating unit, and which outputs the sum.

2. The electronic musical instrument according to claim 1, wherein a plurality of resonance circuits which correspond to harmonics of a musical tone and whose resonance frequencies are defined as harmonic frequencies of the harmonics are connected in parallel to constitute the resonance-tone generating unit.

3. The electronic musical instrument according to claim 2, wherein the resonance circuits comprise digital filters, and regarding filter coefficients used in each of these filters, an impulse response of the resonance circuit is defined to approximately simulate a vibration waveform of a harmonic, and the vibration waveform can be reproduced by a single-degree-of-freedom viscous damping model;

model parameters for determining the behavior of the single-degree-of-freedom viscous damping model are defined as a mass, damped natural frequency, and damping factor, and given these, a viscosity coefficient and stiffness coefficient, serving as coefficients of an equation of motion of the model, are determined;

the equation of motion of the model is subjected to a Laplace transform to obtain a transfer function formula in terms of "s", and the filter coefficients in terms of "z" are determined by substituting the determined viscosity coefficient, stiffness coefficient, and mass in the transfer function formula and performing a bilinear transformation; and the mass is defined as a desired value, the damped natural frequency is the frequency of the harmonic to be simulated, and the damping factor is defined as an exponent obtained when damping of the harmonic is approximated by an exponential function to determine the values of the filter coefficients.

4. The electronic musical instrument according to claim 3, wherein, when multipliers are provided so as to be respectively connected in series to the digital filters of the resonance circuits, the multiplication factor of each of the multipliers is set to a value obtained by multiplying the amplitude ratio with a reference harmonic of a musical tone that includes the harmonic corresponding to the multiplier, by a predetermined degree.

5. The electronic musical instrument according to claim 3, wherein, when the musical-tone generating unit reads out a stored musical-tone waveform to generate the musical tone, the harmonic to be simulated is extracted from the stored musical-tone waveform.

6. The electronic musical instrument according to claim 3, wherein, when the musical-tone generating unit synthesizes a musical tone using predetermined musical-tone control information to generate the musical tone, the harmonic to be simulated is extracted from the output musical-tone waveform formed by synthesizing the musical tone using the predetermined musical-tone control information.

7. The electronic musical instrument according to claim 1, wherein the resonance frequency of one resonance circuit corresponds to one harmonic frequency, but when there are a plurality of harmonics whose harmonic frequencies are equal or whose harmonic frequencies are extremely close, one harmonic frequency is set as a representative frequency, and only one resonance circuit whose resonance frequency is defined by that harmonic frequency is used for the plurality of harmonics.

8. The electronic musical instrument according to claim 1, wherein the resonance frequency of one resonance circuit corresponds to one harmonic frequency, but the resonance-tone generating unit comprises a resonance circuit whose resonance frequency corresponding to a specific harmonic frequency is shifted by a predetermined amount.

9. The electronic musical instrument according to claim 1, wherein the resonance-tone generating unit comprises a configuration in which an output thereof is multiplied by a predetermined degree, the product is added to the input musical tone, and the sum is input again to this resonance-tone generating unit as feedback.

10. The electronic musical instrument according to claim 1, wherein the resonance-tone generating unit comprises a configuration in which an output thereof is multiplied by a predetermined degree, the product is added to the input musical tone, and the sum is input again to this resonance-tone generating unit as feedback, and a delay circuit for delaying the output of the resonance-tone generating unit by a predetermined time and/or a filter for changing the amplitude-frequency characteristic of the output of the resonance-tone generating unit is provided in a feedback path of the configuration.

11. An electronic musical instrument comprising, at least for outputting a musical tone:

musical-tone control means comprising a plurality of operators, for generating operating information of the plurality of operators as musical-tone control information for specifying at least a sound-generation start, a sound-generation stop, a pitch, an operating intensity, and an operating amount;

musical-tone generating means capable of simultaneously generating a plurality of musical tones according to the musical-tone control information;

resonance-tone generating means comprising a plurality of resonance circuit groups and a plurality of input series corresponding to each of the plurality of resonance circuit groups, for adding and outputting resonance-tone outputs of the plurality of resonance circuit groups; and resonance-tone mixing means for multiplying a resonance tone generated by the resonance-tone generating means, by a predetermined degree according to the musical-tone control information, for adding the product to the input musical tone from the musical-tone generating means, and for outputting the sum, wherein the musical-tone generating means comprises:

musical-tone producing means comprising a plurality of musical-tone producing channels, for producing and outputting a musical tone according to the musical-tone control information;

multipliers equal in number to all note names, provided for each of the plurality of musical-tone producing channels, for multiplying a factor to adjust the amplitude of the musical tone according to the musical-tone control information, at least the factor of a multiplier having the same note name as the musical tone generated by the musical-tone generating means being different from those of the other multipliers; and adders provided corresponding to the plurality of resonance circuit groups of the resonance-tone generating means, respectively, for adding signals output from multipliers corresponding to identical note names for the plurality of musical-tone producing channels among the outputs from the multipliers, and the outputs of the plurality of musical-tone producing channels are input to the multipliers of the channels, the outputs from multipliers corresponding to identical note names for the plurality of musical-tone producing channels are added in the adders provided corresponding to the plurality of resonance circuit groups of the resonance-tone generating means, respectively, and are sent and input to the respective resonance circuit groups, and the resonance-tone generating means produces a resonance tone and outputs it to the resonance-tone mixing means.

12. The electronic musical instrument according to claim 11, wherein each of the plurality of musical-tone generating channels of the musical-tone generating means has multipliers equal in number to the note names of the plurality of resonance circuit groups, the multiplication factors of the multipliers are determined by a pitch in the musical-tone control information, the multiplication factor of one of the multipliers is set to be smaller than the multiplication factors of the other multipliers, and all the multiplication factors of the other multipliers are set to be equal.

13. The electronic musical instrument according to claim 11, wherein the number of the input series of the resonance-tone generating means corresponds to the number of the note names of the plurality of resonance circuit groups, and the number of division series of output channels of musical-tone dividing means also corresponds to the same number.

14. The electronic musical instrument according to claim 11, wherein, in each of the plurality of resonance circuit groups of the resonance-tone generating means, a plurality of resonance circuits corresponding to harmonics of the musical tone corresponding to the note name of the resonance circuit group is connected in parallel.

15. The electronic musical instrument according to claim 11, wherein the resonance circuits comprise digital filters, and regarding filter coefficients used in each of these filters, an impulse response of the resonance circuit is defined to approximately simulate a vibration waveform of a harmonic, and the vibration waveform can be reproduced by a single-degree-of-freedom viscous damping model;

model parameters for determining the behavior of the single-degree-of-freedom viscous damping model are defined as a mass, damped natural frequency, and damping factor, and given these, a viscosity coefficient and stiffness coefficient, serving as coefficients of an equation of motion of the model, are determined;

the equation of motion of the model is subjected to a Laplace transform to obtain a transfer function in terms of "s", and the filter coefficients in terms of "z" are determined by substituting the determined viscosity coefficient, stiffness coefficient, and mass in the transfer function formula and performing a bilinear transformation; and the mass is defined as a desired value, the damped natural frequency is the frequency of the harmonic to be simulated, and the damping factor is defined as an exponent obtained when damping of the harmonic is approximated by an exponential function to determine the values of the filter coefficients.

16. The electronic musical instrument according to claim 15, wherein, when multipliers are provided so as to be respectively connected to in series the digital filters of the resonance circuits, the multiplication factor of each of the multipliers is set to a value obtained by multiplying the amplitude ratio with a reference harmonic of a musical tone that includes the harmonic corresponding to the multiplier, by a predetermined degree.

17. The electronic musical instrument according to claim 11, wherein, when the musical-tone generating means reads out a stored musical-tone waveform to generate the musical tone, the harmonic to be simulated is extracted from the stored musical-tone waveform.

18. The electronic musical instrument according to claim 11, wherein, when the musical-tone generating means synthesizes a musical tone using predetermined musical-tone control information to generate the musical tone, the harmonic to be simulated is extracted from the output musical-tone waveform formed by synthesizing the musical tone using the predetermined musical-tone control information.

19. The electronic musical instrument according to claim 11, wherein the resonance frequency of one resonance circuit corresponds to one harmonic frequency, but when there are a plurality of harmonics whose harmonic frequencies are equal or whose harmonic frequencies are extremely close, one harmonic frequency is set as a representative frequency, and only one resonance circuit whose resonance frequency is defined by that harmonic frequency is used for the plurality of harmonics.

20. The electronic musical instrument according to claim 11, wherein the resonance-tone generating means comprises a configuration in which an output thereof is multiplied by a predetermined degree, the product is added to the input musical tone, and the sum is input again to this resonance-tone generating means as feedback.

21. The electronic musical instrument according to claim 11, wherein the resonance-tone generating means comprises a configuration in which an output thereof is multiplied by a predetermined degree, the product is added to the input musical tone, and the sum is input again to this resonance-tone generating means as feedback, and a delay circuit for delaying the output of the resonance-tone generating means by a predetermined time and/or a filter for changing the amplitude-frequency characteristic of the output of the resonance-tone generating means is provided in a feedback path of the configuration.

22. An electronic musical instrument comprising, at least for outputting a musical tone:

a musical-tone control unit comprising a plurality of operators, which generates operating information of the plurality of operators as musical-tone control information for specifying at least a sound-generation start, a sound-generation stop, a pitch, an operating intensity, and an operating amount;

a musical-tone generating unit which simultaneously generates a plurality of musical tones according to the musical-tone control information;

a resonance-tone-waveform storing unit having stored resonance-tone waveforms;

a resonance-tone generating unit which simultaneously generates a plurality of resonance tones by reading out the resonance-tone waveforms from the resonance-tone-waveform storing unit according to the musical-tone control information; and a resonance-tone mixing unit which multiplies a resonance tone generated by the resonance-tone generating unit, by a predetermined degree according to the musical-tone control information, which adds the product to an input musical tone from the musical-tone generating unit, and which outputs the sum.

23. The electronic musical instrument according to claim 22, wherein the resonance-tone waveforms stored in the resonance-tone-waveform storing unit are formed by storing in advance output waveforms obtained by inputting a musical tone to a configuration in which a plurality of resonance circuits corresponding to harmonics of musical tones that can be generated is connected in parallel.

24. The electronic musical instrument according to claim 23, wherein the resonance circuits comprise digital filters, and regarding filter coefficients used in each of these filters, an impulse response of the resonance circuit is defined to approximately simulate a vibration waveform of a harmonic, and the vibration waveform can be reproduced by a single-degree-of-freedom viscous damping model;

model parameters for determining the behavior of the single-degree-of-freedom viscous damping model are defined as a mass, damped natural frequency, and damping factor, and given these, a viscosity coefficient and stiffness coefficient, serving as coefficients of an equation of motion of the model, are determined;

the equation of motion of the model is subjected to a Laplace transform to obtain a transfer function formula in terms of "s", and the filter coefficients in terms of "z" are determined by substituting the determined viscosity coefficient, stiffness coefficient, and mass in the transfer function formula and performing a bilinear transformation; and the mass is defined as a desired value, the damped natural frequency is the frequency of the harmonic to be simulated, and the damping factor is defined as an exponent obtained when damping of the harmonic is approximated by an exponential function to determine the values of the filter coefficients.

25. The electronic musical instrument according to claim 24, wherein, when multipliers are provided so as to be respectively connected in series to the digital filters of the resonance circuits, the multiplication factor of each of the multipliers is set to a value obtained by multiplying the amplitude ratio with a reference harmonic of a musical tone that includes the harmonic corresponding to the multiplier, by a predetermined degree.

26. The electronic musical instrument according to claim 22, wherein, when the musical-tone generating unit reads out a stored musical-tone waveform to generate the musical tone, the harmonic to be simulated is extracted from the stored musical-tone waveform.

27. The electronic musical instrument according to claim 22, wherein, when the musical-tone generating unit synthesizes a musical tone using predetermined musical-tone control information to generate the musical tone, the harmonic to be simulated is extracted from the output musical-tone waveform formed by synthesizing the musical tone using the predetermined musical-tone control information.

28. The electronic musical instrument according to claim 22, wherein the resonance-tone generating unit comprises a configuration in which an output thereof is multiplied by a predetermined degree, the product is added to the input musical tone, and the sum is input again to this resonance-tone generating unit as feedback.

29. The electronic musical instrument according to claim 22, wherein the resonance-tone generating unit comprises a configuration in which an output thereof is multiplied by a predetermined degree, the product is added to the input musical tone, and the sum is input again to this resonance-tone generating unit as feedback, and a delay circuit for delaying the output of the resonance-tone generating unit by a predetermined time and/or a filter for changing the amplitude-frequency characteristic of the output of the resonance-tone generating unit is provided in a feedback path of the configuration.

* * * * *